US007143711B1

(12) United States Patent
Wolske

(10) Patent No.: US 7,143,711 B1
(45) Date of Patent: Dec. 5, 2006

(54) TRIM TAB SHAPE CONTROL SYSTEM

(76) Inventor: James P. von Wolske, 2107 Lakeshore Dr., Austin, TX (US) 78746

( * ) Notice: Subject to any disclaimer, the term of this patent is extended or adjusted under 35 U.S.C. 154(b) by 0 days.

(21) Appl. No.: 11/279,010

(22) Filed: Apr. 7, 2006

Related U.S. Application Data

(60) Provisional application No. 60/669,144, filed on Apr. 7, 2005.

(51) Int. Cl.
*B63B 1/22* (2006.01)

(52) U.S. Cl. ..... 114/285; 114/286

(58) Field of Classification Search ..... 114/285, 114/286
See application file for complete search history.

(56) References Cited

U.S. PATENT DOCUMENTS

| | | | | |
|---|---|---|---|---|
| 3,200,782 | A | 8/1965 | Walden et al. | |
| 3,565,030 | A | 2/1971 | Curtis | |
| 3,678,874 | A * | 7/1972 | Flink | 114/285 |
| 3,977,349 | A * | 8/1976 | Hummel | 114/287 |
| 4,597,742 | A | 7/1986 | Finkl | |
| 4,846,741 | A | 7/1989 | Betsinger | |
| 4,896,622 | A | 1/1990 | Thomas | |
| 4,909,175 | A | 3/1990 | Arnseson | |
| 4,967,682 | A | 11/1990 | O'Donnell | |
| 5,100,350 | A | 3/1992 | Buzzi | |
| 5,171,175 | A | 12/1992 | Buzzi | |
| 5,215,029 | A | 6/1993 | Davis | |
| 5,667,415 | A | 9/1997 | Arneson | |
| 6,138,601 | A | 10/2000 | Anderson et al. | |
| 6,464,549 | B1 | 10/2002 | Buzzi | |
| 6,571,724 | B1 | 6/2003 | Shen | |
| 6,684,807 | B1 | 2/2004 | Smith | |
| 6,745,715 | B1 | 6/2004 | Shen et al. | |
| 6,823,812 | B1 | 11/2004 | von Wolske | |
| 6,851,991 | B1 | 2/2005 | Eriksson | |
| 6,863,013 | B1 | 3/2005 | Noyes, Jr. | |
| 2005/0155540 | A1* | 7/2005 | Moore | 114/219 |

* cited by examiner

*Primary Examiner*—Stephen Avila
(74) *Attorney, Agent, or Firm*—Gary R. Stanford

(57) ABSTRACT

A trim tab shape control system for a boat with a transom according to an embodiment of the present invention includes a flexible plate and a trim tab control system. The flexible plate has a forward end attached to the transom, a rearward end, and an operative bottom surface. The trim tab control system includes a first force mechanism that is attached near the rearward end of the flexible plate and at least one second force mechanism interfacing the flexible plate between the transom and the first force mechanism. The force mechanisms are operative to deflect the operative bottom surface of the flexible plate in a controlled curve while in an up position, where the plate retains a shape in a down position which varies with force applied by the first and second force mechanisms and the operating conditions of the boat.

29 Claims, 27 Drawing Sheets

TRIM TAB SHAPE CONTROL SYSTEM

CROSS-REFERENCE TO RELATED APPLICATIONS

This application claims the benefit of U.S. Provisional Application Ser. No. 60/669,144 filed on Apr. 7, 2005, which is herein incorporated by reference for all intents and purposes.

BACKGROUND OF THE INVENTION

1. Field of the Invention

The present invention relates to boating, and more specifically to a trim tab shape control system for trim tabs located at the stem of the boat to control the flight attitude of the boat.

2. Description of the Related Art

Trim tabs have been used for a long time to change the "attitude" of a boat. Attitude is the angle of the boat relative to the water surface, and changes under different operating conditions. The attitude of a boat relative to the water surface has a profound effect on the speed and efficiency of the boat. Attitude is usually discussed in terms of the nose up/nose down adjustment of the boat, and is sometimes called the trim angle. The term "trim angle" often leads to ambiguity as to whether it is the angle of the boat, or the trim tabs, or the outdrive being discussed. The present disclosure attempts to be more specific in discussing trim angle.

Trim tabs are usually fastened to the boat at or near the stem and on the transom or on the bottom of the hull. The transom generally forms the rearmost portion of the stem, such as the generally flat and vertical rearward end of the hull of the boat. When underway, water rushes under the boat, causing the rear of the boat to be deflected up or down by the trim tabs. Pushing the trim tab down deflects the departing water downward to boost the rear of the boat up into the air slightly, thus bringing the bow of the boat down. Pulling the trim tab up is intended to pull the rear of the boat down and to bring the bow up. Thus, "down on the trim tabs" means "down on the bow" and, conversely, "up on the trim tabs" means "up on the bow". It is noted, however, that the "up on the trim tabs" operation of prior art trim tabs has limited effectiveness. Attitude may sometimes be discussed in terms of the left or right lean of a boat under way. Leaning may be due to propeller torque, uneven weight distribution, or cornering. Trim tabs may also be used to correct this leaning.

Although trim tabs are an appurtenance to the hull, they serve to modify the shape of the planing surface and, therefore, from the perspective of hydrodynamics of the boat planing on the water, it is immaterial whether the trim tabs are considered as part of the hull or an appurtenance.

Prior art trim tabs are only somewhat effective in changing the attitude of the boat. Early prior art trim tabs were hinged where they joined the hull of the boat and usually were a rigid flat plate essentially parallel to the bottom surface of the hull. This flat plate could swing up or down several degrees via mechanical means. A major deficiency of flat plate hinged trim tabs is that the up tab position causes an abrupt change in the contour of the surface running on the water. This abrupt change causes flow separation at the hinge point. As with any airfoil, flow separation causes loss of lift. The hinged flat plate is simply a crude airfoil with poor lift to drag ratio and is not very successful at raising the nose of the boat. Hinge type trim tabs in the down position will lower the bow of the boat, but have a poor lift to drag ratio and tend to impose excessive drag in order to generate an equivalent amount of lift of present invention.

More recent prior art trim tabs are of a bending flat plate type whereby the trim tab is a resilient plate of uniform thickness and stiffness. A flat plate is attached solidly in a cantilever fashion to the boat hull and does not use a hinged joint but rather relies on the bending of the flat plate slightly up or down to generate a somewhat better, but still deficient, approximation of an airfoil. The bending flat plate trim tabs were flexed down and up by the boat operator to add hook or rocker as desired. Hook is usually caused by a concave surface on the bottom of the boat, when viewed from below the boat, which tends to lower the bow while underway. Rocker is usually caused by a convex surface on the bottom of the boat, when viewed from below the boat, which tends to raise the bow of the boat while underway. The bending flat plate trim tabs were slightly more effective than hinged type plates. Although somewhat superior to hinged plate designs, the bending flat plate also has excessive drag for the amount of lift generated. Bending flat plate trim tabs are somewhat better than the hinged type in that the problematic abrupt change of angle of the hinge type is softened. This curved surface method decreases the tendency of flow separation, but uses a plate of constant flexural stiffness, so that the curvature is fairly localized at the point of attachment to the boat and diminishes as the water moves rearward away from the area of attachment of the plate to the hull.

Prior art trim tabs have now advanced to the use of a regressive flexural stiffness tab extending out rearward from the transom in a cantilevered fashion. This minimizes boundary layer separation in the up position by assuming the shape of a curve similar to a parabola. This shape improves the effective lift to drag ratio of the trim tab over earlier prior art. This recent prior art trim tab has an equal stiffness in the up direction as in the down direction. Excessive downward motion will cause the trim tab to break off due to fatigue failure or ductile failure.

It is desirable to have greater downward deflection capabilities than upward deflection capabilities. A trim tab shape control system according to an embodiment of the present invention is an improvement over U.S. Pat. No. 6,823,812 issued Nov. 30, 2004 to James P. von Wolske (hereinafter noted as "von Wolske 812").

BRIEF DESCRIPTION OF THE DRAWINGS

The benefits, features, and advantages of the present invention will become better understood with regard to the following description and accompanying drawings (the letters "S", "R", and "T" appended to the Figure number denote side, rear, and top views, respectively, of the objects being illustrated), in which.

DETAILED DESCRIPTION

Figure 1:
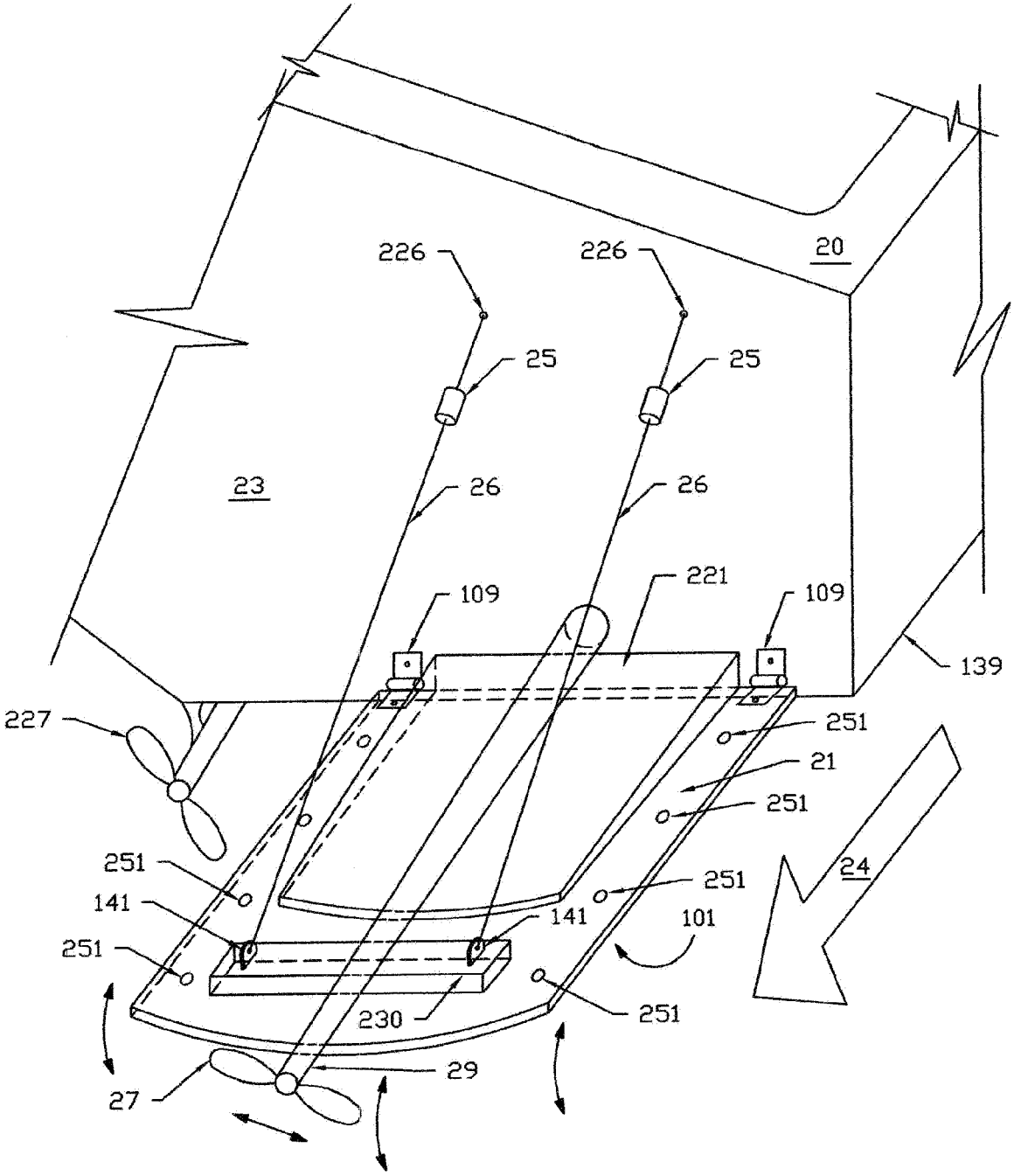
FIG. 1 is a perspective view of the rear, starboard side of a boat showing a trim tab shape control system according to an embodiment of the present invention attached to the stem of the boat and located flush with the bottom surface of the boat and also showing a surface drive propeller system mounted above the trim tab.

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed. It is noted that the same reference characters used in multiple Figures to point out the same apparatus or a similar apparatus with the same or analogous functionality.

Figure 11:
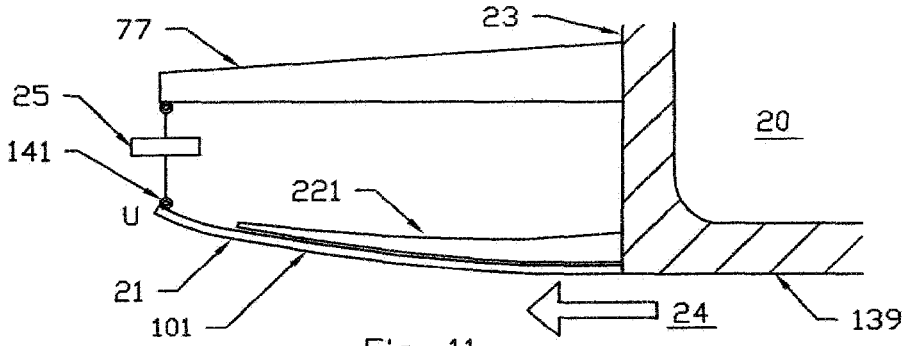
FIG. 11 is a side view of a boat with a trim tab shape control system implemented according to an embodiment of the present invention which is flexed up and down by a single force ram combined with a regressive flexural stiffness beam acting as a platen to allow greater down trim effects than possible with prior art configurations, in which the trim tab is flexed into the up position.
Figure 13:
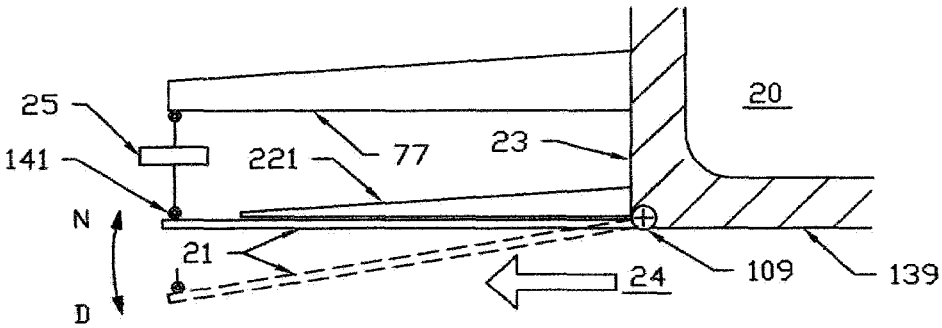
FIG. 13 is a side view of a boat with a trim tab shape control system implemented according to an embodiment of the present invention similar to that shown in FIG. 12 except including a hinged trim tab allowing greater down trim effects.

FIG. 1 is a perspective view of the rear, starboard side of a boat showing a trim tab shape control system according to an embodiment of the present invention attached to the stem of a boat 20 and located flush with the bottom surface 139 of the boat and also showing a surface drive propeller system mounted above the trim tab 21. FIG. 1 illustrates the boat 20 moving through water indicated by arrow 24. An arrow is used to indicate the direction of water flow relative to the boat 20 and the size of the arrow denotes the relative force of the water generally indicating the speed of the boat 20. The boat 30 is pushed by a propeller 27 which is spun by a propeller shaft inside a propeller shaft carrier 29. This propeller arrangement is shown as a surface drive assembly common to the industry. A trim tab 21 is attached to the transom 23 of the boat 20 by hinges 109. The trim tab 21 comprises a bendable or resilient thin plate of uniform thickness and stiffness from its front end attached to the boat 20 to its rear end near the propeller 27. The trim tab 21 has an undersurface 101 which interfaces the water 24 such that the undersurface 101 serves as the operative bottom surface of the trim tab 21. The trim tab may be constructed of a simple sheet of flexible sheet metal for a cost savings advantage over prior art. This sheet metal can be simply bolted to the boat 20 for a cantilever connection, such as shown in FIG. 11, or can be hinged to the boat 20 as shown in FIGS. 1 and 13.

Figure 2:
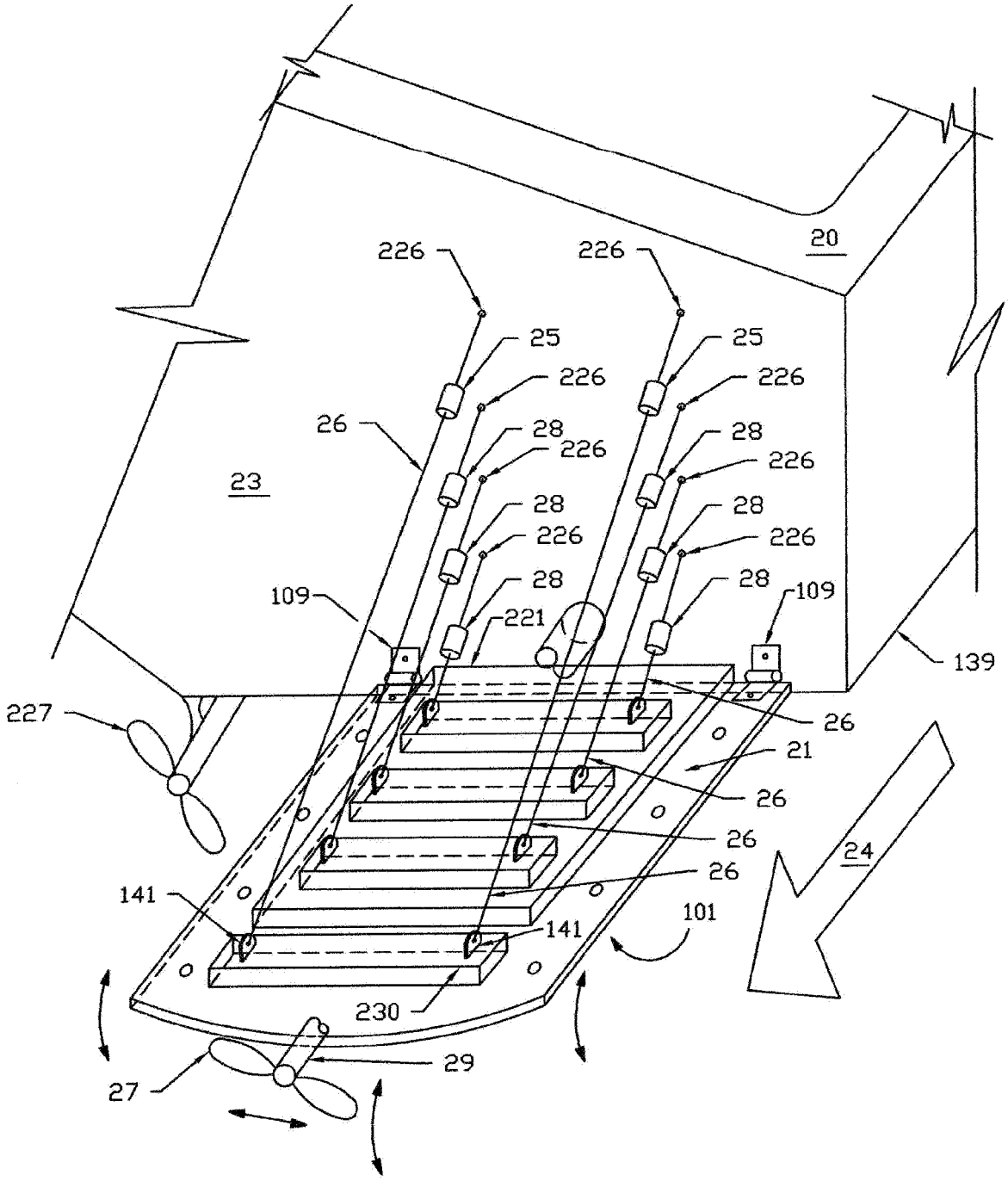
FIG. 2 is a perspective view of the rear, starboard side of a boat similar to FIG. 1 illustrating a more complex trim tab shape control system for controlling the shape of the trim tab and including a platen to modify the curvature of the trim tab.
Figure 3R:
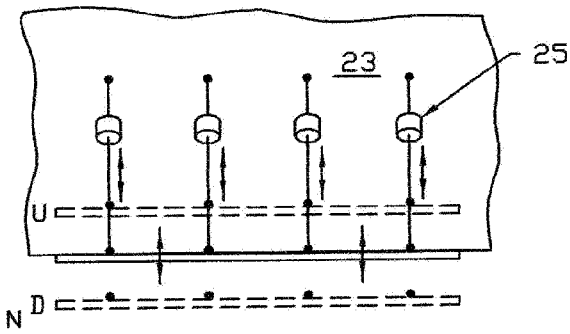
Fig. 3R (prior art)
FIG. 3R is a rear view of a boat showing a prior art trim tab common to drag racing boats.
Figure 3S:
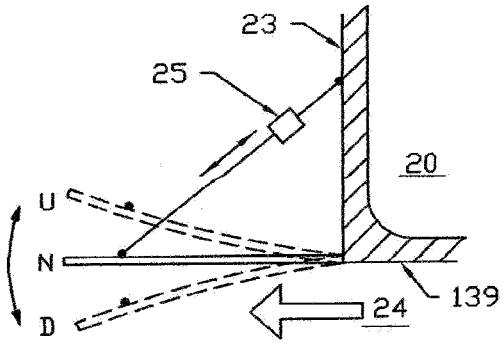
Fig. 3S (prior art)
FIG. 3S is a side view of the boat of FIG. 3R showing the side of the boat and transom area including a prior art trim tab and a force ram (it is noted that reference characters "N", "U" and "D" in this and following Figures denote neutral, up, and down positions, respectively, of the trim tab)

In FIGS. 1 and 2, a rib 230 is attached at the rearward end of the trim tab 21 and serves as a transverse stiffener and has a point of attachment to a forcing mechanism. The point of attachment is an ear 141 with a hole through it for a force rod 26 which is connected to a force ram 25 which is connected to transom ear 226 at its anchor point at the transom 23. The transom ear 226 is shown as a dot or point but may be configured in a similar manner as the ear 141. Each force ram 25 is an actuator, and each actuator described herein, including the force rams 25, platen rams 28, and yardarm braces 225 (FIG. 40), etc., may be implemented using any suitable actuator technology, such as hydraulic piston cylinder rams, electrostrictive materials (e.g. shape memory allows and the like), piezoelectric materials, power jack screws, in any of the previously discussed embodiments and may prove to be superior as the technology evolves. The use of shape memory alloy (SMA) is a technology particularly attractive to present invention in that it has no moving parts and has a response time of about 1 second. Electrostrictive and piezoelectric materials have a displacement as a function of electrical energy.

As shown in FIG. 1, a regressive flexural stiffness beam acting as a platen 221 is attached in cantilever fashion to the transom 23 of the boat 20 immediately above the trim tab 21. The regressive flexural stiffness platen 221 controls the shape of the operative bottom surface 101 of the trim tab 21 when pulled into an up position. In particular, when the force rams 25 pull upwards on the trim tab 21, it is pressed against the platen 221 and bends into a shape that is determined by the regressive flexural stiffness of the platen 221. Operation of the up position is similar to that shown in FIG. 11. Although the configuration of the force means is different and the trim tab 21 in FIG. 11 is cantilevered rather than hinged, operation is substantially identical when in the up position as shown. The regressive flexural stiffness of the platen 221 causes the operative bottom surface 101 of the trim tab 21 into a progressive curve such that the rear end of the platen 221 to bend more than its forward end as illustrated in FIG. 11.

The regressive flexural stiffness of the platen 221 causes the bending of the operative bottom surface 101 of the trim tab 21 to be curved to the exact shape to optimize the operating conditions of the boat. Fluid dynamics shows that the "up" curvature is the one that needs to be most closely tuned to the operating condition of the boat due to the desire of avoiding boundary layer separation of the water from the undersurface of the trim tab 21. This boundary layer separation is caused by the formation of an adverse pressure gradient at the undersurface of the trim tab 21. Conversely, down trim does not cause these adverse pressure gradients and therefore boundary layer separation is not a problem. The more that the trim tab 21 is pulled up, the more the flow tends to separate. As described further below, pressure sensors may be employed with communications piped from the bottom of the trim tab to a smart logic box to monitor local boundary layer pressures to determine incipient flow separation and to make necessary adjustments to the trim tab deflection.

Despite the fact that certain embodiments of the present invention use a tapered cantilevered spring as one of several means of platens 221 to help shape the curve of the trim tab 21 when in the up position only, the tapered cantilever spring is not an actual trim tab 21. This difference allows a much broader application of a system according to the present invention over prior art.

FIG. 2 is a perspective view of the rear, starboard side of a boat 20 similar to that shown in FIG. 1 illustrating a more complex trim tab shape control system for changing the shape of the trim tab 21 and including a platen 221 to modify the curvature of the trim tab 21. Similar items as those shown in FIG. 1 assume identical reference numbers. The trim tab 21 is configured in substantially the same manner as that shown in FIG. 1 and is attached to the boat 20 using hinges 109 in a similar manner. As shown in FIG. 2, a flat beam acting as a platen 221 is attached in cantilever fashion to the transom 23 of the boat 20 immediately above the trim tab 21. The platen 221 in this case is not a regressive flexural stiffness platen 221, but instead has a uniform thickness and stiffness across its length. Instead, multiple ribs 230 are attached along the length of the platen. The point of attachment of each rib 230 is an ear 141 with a hole through it for a force rod 26 which is connected to a platen ram 28 which is connected to a transom ear 226 at its anchor point at the transom 23. Each platen ram 28 is an actuator similar to that previously described for the force rams 25. In this case, the platen rams 28 manipulate the shape of the platen 221 to control the shape of the operative bottom surface 101 of the trim tab 21 when pulled into an up position. In particular, the platen rams 28 are operated to control the shape of the platen 221, so that when the force rams 25 pull upwards on the trim tab 21, the trim tab 21 is pressed against the shape-controlled platen 221 and thus bends into a shape that is determined by the shape of the platen 221. The resulting shape of the operative bottom surface 101 of the trim tab 21 is similar to that shown in FIG. 11 when flexed into the up position.

It is noted that the platen rams 28 directly control the shape of the platen 221 and thus enable a significantly greater level of control of the shape of the trim tab 21 and its operative bottom surface 101 as compared to the regressive flexural stiffness platen 221 shown in FIG. 1.

Figure 4R:
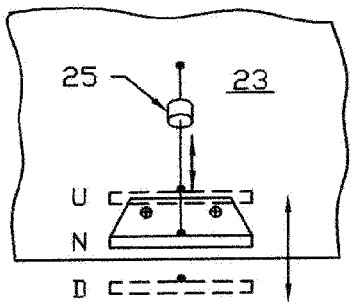
Fig. 4R (prior art)
FIG. 4R is a rear view of a boat showing a prior art trim tab common to pleasure cruising boats.
Figure 4S:
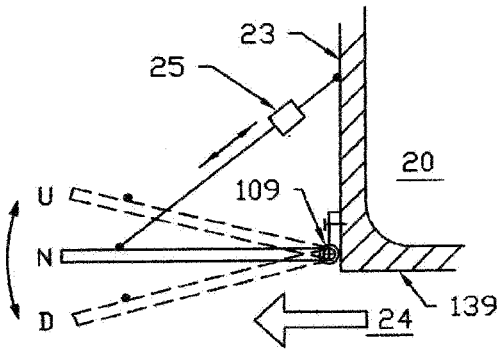
Fig. 4S (prior art)
FIG. 4S is a side view of the boat of FIG. 4R showing the side of the boat and transom area including a prior art hinged, rigid body trim tab and force ram.
Figure 5R:
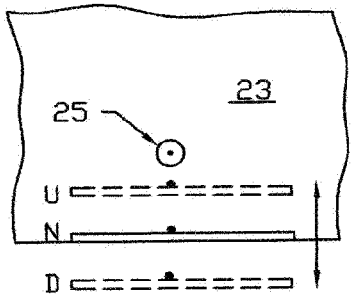
Fig. 5R (prior art)
FIG. 5R is a rear view of a boat showing a prior art trim tab similar to that shown in FIGS. 3R and 3S and using a single force ram.
Figure 5S:
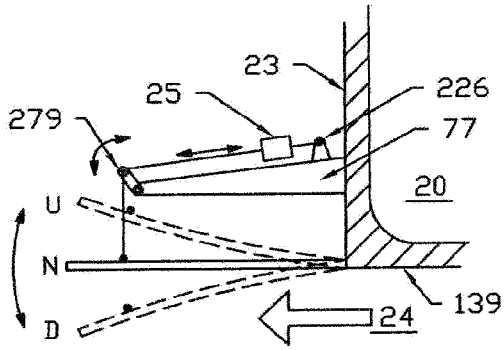
Fig. 5S (prior art)
FIG. 5S is a side view of the boat of FIG. 5R showing the side of a boat and transom area including a prior art flexed trim tab and yardarm attached to the transom for support of the force ram.
Figure 6R:
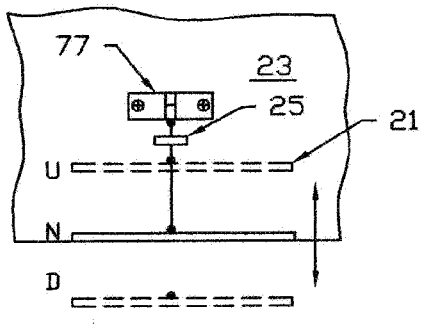
Fig. 6R (prior art)
FIG. 6R is a rear view of a boat showing a prior art trim tab similar to that shown in FIGS. 5R and 5S, but using a single force ram.
Figure 6S:
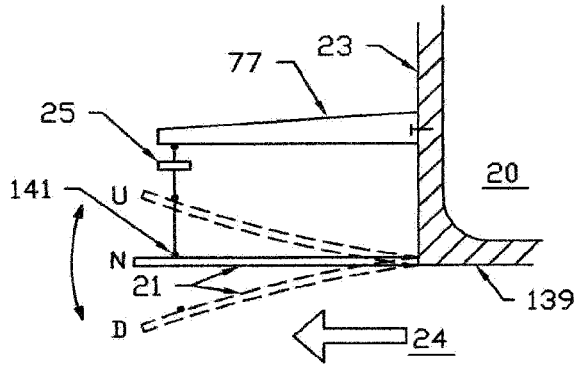
Fig. 6S (prior art)
FIG. 6S is a side view of the boat of FIG. 6R showing the side of a boat and transom area including a prior art flexed trim tab and yardarm support for the force ram.

FIGS. 3R and 3S, 4R and 4S, 5R and 5S, and 6R and 6S are prior art and shown for comparison and contrast to present invention. In each case, a trim tab is shown with solid lines in the neutral position and dashed lines for both the up and down positions. In FIGS. 3R, 3S, 4R and 4S, a force ram 25 is attached to the transom 23 of the boat 20 and towards the rearward end of a trim tab for pulling it up and down. In FIGS. 3R, 3S, 5R, 5S, 6R and 6S, the trim tab is cantilevered so that up and down force applied by the force ram 25 causes the trim tab to bend up and down, respectively. In FIGS. 5R and 5S, the force ram 25 interfaces a yardarm 77 attached to the transom 23 in cantilevered fashion above the trim tab, in which the yardarm 77 includes an anchor point and a crank arm 279 for the force ram 25 as illustrated. Force ram 25 pushes or pulls on crank arm 279 which in turn pushes or pulls on the trim tab and causes the trim tab to be moved down or up. In FIGS. 6R and 6S, the force ram 25 is positioned between the yardarm 77 and the trim tab. The curvature of the trim tab for the cantilevered configurations exhibits the deficiency that most of the curvature is concentrated at the point of attachment to the transom 23. In FIGS. 4R and 4S, the trim tab is attached to the transom 23 with hinges 109, so that the trim tab does not flex or bend but instead pivots up and down.

As shown in FIG. 6S, the curvature for an end loaded and uniformly loaded cantilevered beam of uniform flexural stiffness is well known to one skilled in the art of the engineering field known as the "Mechanics of Deformable Bodies" or "Strength of Materials". This curvature is always concentrated at the cantilever point and decreases to zero at the farthest end where the bending moments go to zero. The concept of cantilever is when a beam is integral with or mounted at one end to a solid object and is held to resist linear forces, bending moments, and torque. In engineering terminology, this type of mounting is generally referred to as a "clamped joint".

Figure 7R:
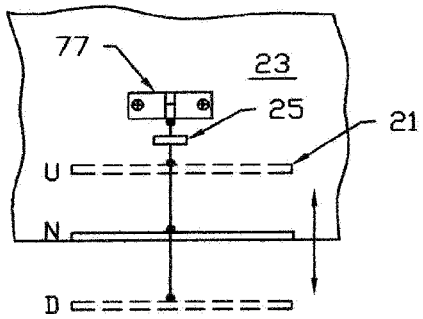
FIGS. 7R and 7S are rear and side views, respectively, of a boat showing a trim tab shape control system according to an embodiment of the present invention including multiple force rams attached in a line to a common yardarm showing the trim tab flexed and showing the multiple force rams located along the active length of the trim tab.
Figure 7S:
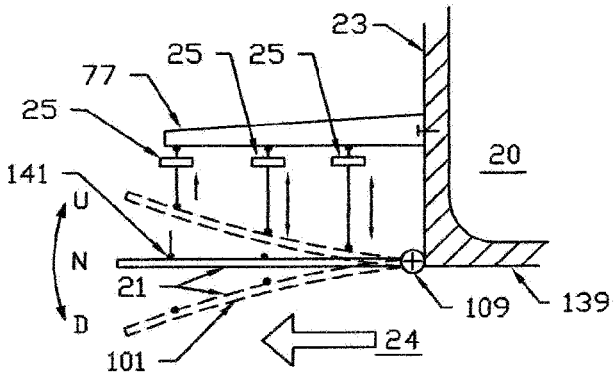

FIGS. 7R and 7S are rear end and side views, respectively, of a trim tab shape control system in accordance with an embodiment of the present invention using three force rams 25 attached to a trim tab 21 which is of uniform thickness, but may be of tapered thickness also. A yardarm 77 is attached to the transom 23 in cantilevered fashion above the trim tab 21 including an upper anchor point for the force ram 25, which is attached to the trim tab 21 towards its rearward end. There are three positions shown, up, neutral, and down. FIG. 7S shows how the use of multiple force rams 25 along the length of the trim tab 21 allows for it to be flexed in a curve best suited to the hydrodynamics of the water 24 flow underneath the trim tab 21. The curvature of the trim tab 21 is improved over that shown in FIGS. 3, 4, 5, and 6 which all have the deficiency that most of the curvature is concentrated at the point of attachment to the transom 23.

FIG. 7S shows ears 141 that are the means of attachment of force rams 25 to the trim tab 21. These ears are any of several means to attach the force ram to the trim tab to allow the force ram to both push and pull on the trim tab. The ears may be a simple small piece of metal attached to and projecting upward from the trim tab and having a hole through it such that a clevis end can be secured with a pin through the ear. These ears 41 are shown as solid dots on the upper surface of the trim tab corresponding to the attachment points of the three force rams shown. This schematic representation is also shown on FIG. 8 through FIG. 25. In FIG. 7S, the attachment point of the trim tab 21 to the transom 23 is via a hinge 109, however, the abrupt angle of a hinge can be a problem if only one force ram 25 is used as shown in FIG. 4S. Even with the hinge, present invention FIG. 7S can still be bent to the desired hydrodynamic curvature by the use of the multiple force rams 25 placed along the flow length of the trim tab 21 to thus avoid any sharp transitions in the flow of water 24 as it exits from the boat bottom 39 and progresses to the trim tab undersurface 101.

However, it is also well known that the mere contact of the trim tab with the water does cause some added drag force irrespective of whether it is form drag or viscous drag. Therefore, there may be instances when the boat operator desires to raise the trim tabs such that they become fully retracted away from the water exiting out from under the boat. That is to say, it may be desirable to encourage total boundary layer separation of the water from the trim tab to get rid of this added drag force. This total separation is best accomplished by having a very sharp transition upward at the point of attachment of the trim tab to the bottom edge of the transom.

Figure 31:
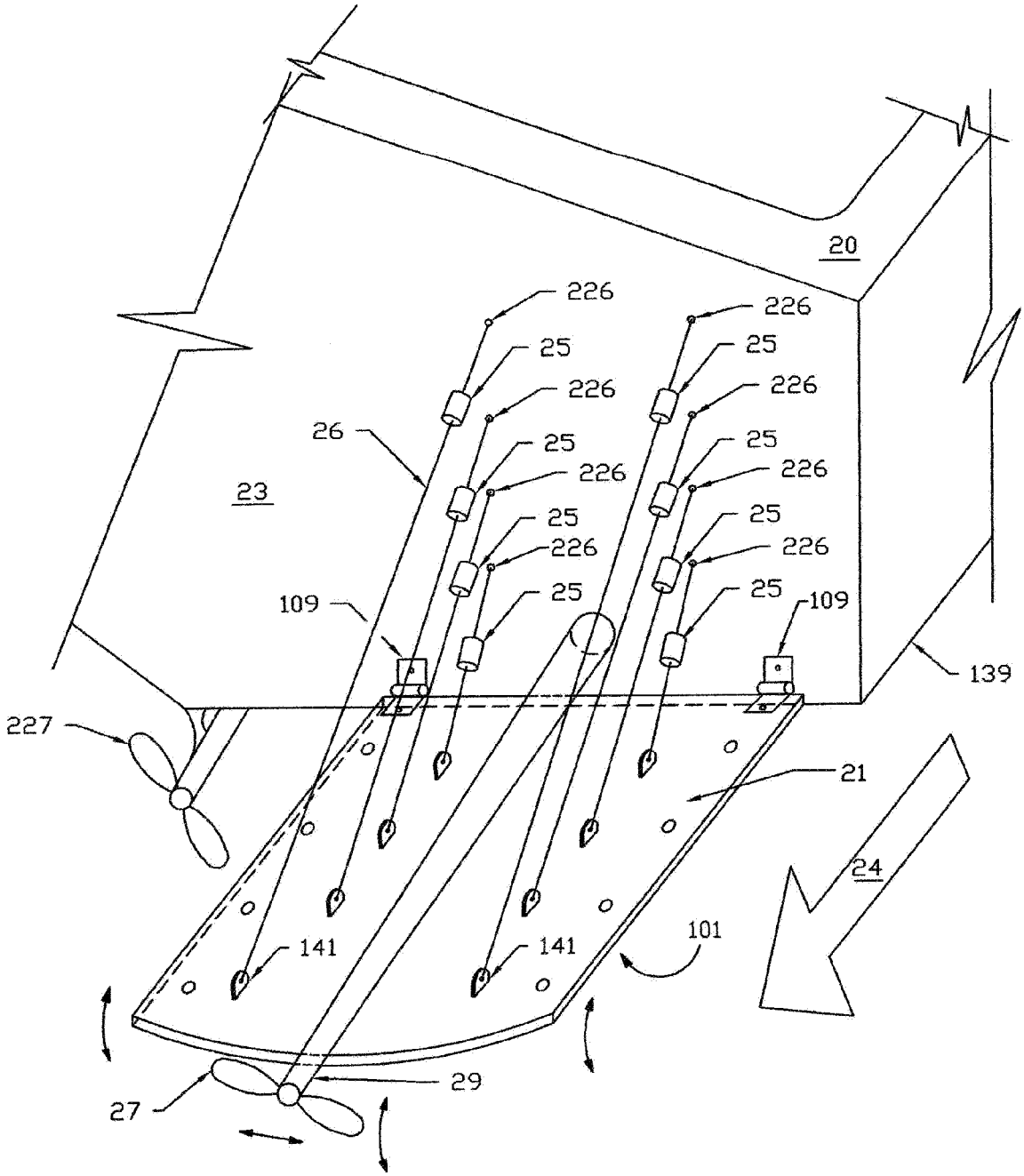
FIG. 31 is a perspective view of the rear right side of a boat and illustrating a trim tab shape control system according to another embodiment of the present invention that is similar to that shown in FIG. 29 and including a hinge connection of the trim tab to the transom.

Therefore, in FIG. 7S, it is also contemplated that the operator can fully retract all three force rams 25 such that the trim tab 21 assumes a shape which rises abruptly and steeply away and upward from hinge 109. Under these circumstances, it is best to actually increase the slope of the trim tab 21 at the hinge point by pulling up extra hard on the force ram 25 closest to the hinge 109. This causes the boundary layer to want to detach at that point of discontinuity of the slope. That is to say, the slope of the trim tab 21 immediately rearward of the hinge 109 is abruptly different and greater than the slope of the bottom 139 of the boat 20. Once the boundary layer detaches and the flow of water 24 is no longer in contact with the trim tab 21, the water usually will not reattach to the trim tab and therefore it is not really necessary to pull the rearward end of the trim tab 21 very far above the surface of the water. This may be desirable when using a surface drive propeller system as shown in FIG. 31.

A person skilled in the art recognizes that the yardarm 77 is simply a mechanical equivalent of the transom 23 as an anchor point and also that the resultant force on the yardarm 77 is vertical whereas the resultant force on the ear 141 is diagonal. Furthermore, a person skilled in the art also recognizes that the diagonal force is resolved into its two vector components of a horizontal force, which plays no meaningful role in this flexure, and a vertical force which is equivalent to the yardarm depiction. FIG. 3 through FIG. 27 are simplified versions to minimize drawing clutter and to emphasize the resultant forces and deflections. FIGS. 1, 2, and 28–41 are perspective drawings to show how the trim tab 21 fits on the boat 20. It is contemplated that in actual construction, either a yardarm in the form of a hull extension similar to a swim platform, or a diagonal connection to the transom 23 as illustrated in the Figures is suitably strong to act as anchor points in order for the trim tab actuators called force rams 25 to work correctly.

Figure 8R:
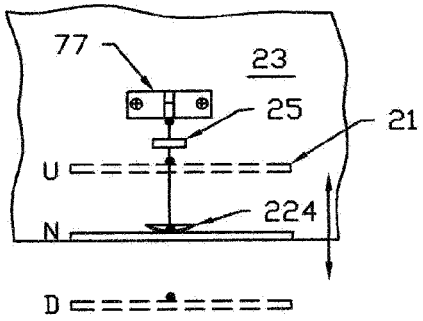
FIGS. 8R and 8S are rear and side views, respectively, of a boat showing a trim tab shape control system according to an embodiment of the present invention with a simplified push ram in conjunction with a push and pull force ram and showing the trim tab flexed by force rams to partially control trim tab curvature.
Figure 8S:
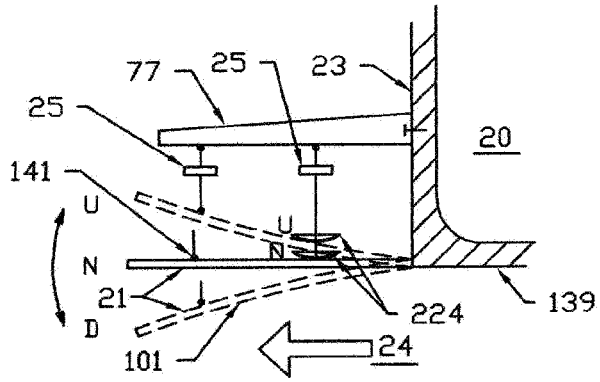

FIGS. 8R and 8S are rear and side views, respectively, of a boat showing a trim tab shape control system according to an embodiment of the present invention with a simplified push ram 25 (positioned closer to the transom 23) in conjunction with a push and pull force ram 25 (towards the rearward end of the trim tab 21) and showing the trim tab 21 flexed by force rams to partially control trim tab curvature. The configuration of FIGS. 8R and 8S is similar to that shown in FIGS. 7R and 7S. FIG. 8S shows two force rams 25 including a first located on the rear end of the trim tab and a second located at a point forward towards the transom 23. The forward force ram has a shoe 224 which is designed for pushing only. Thus, when the trim tab 21 is in the up position, the forward ram is used to push down on the center portion of the trim tab and thus bend it in a curvature more favorable to boundary layer adhesion. The advantage of present invention over prior art configurations is that a trim tab shape control system according to an embodiment of the present invention enables a curvature which is active and which can be controlled more correctly according to the operating conditions the boat. Another advantage of a system according to the present invention is that the push only force ram, exerting force through the shoe 224, stops acting at any position below the neutral position and thus allows for a simpler control system of actuating the force rams. An example of such a situation arises when the boat 20 is traveling at a high rate of speed in large waves wherein the rolling and pitching of the boat causes a discomfort problem to the passengers.

The pitching motion of a boat occurs when the boat traverses large waves in a straight on course causing the cyclic bow down and bow up motion of the boat. An example of how a system according to the present invention counteracts pitching is as follows. When the boat goes over the crest of a large wave and has the bow pointed downward the trim tab is pulled up sharply in an attempt to raise the nose of the boat and is accomplished by pulling up on the rear force ram only. The forward force ram, the push only type, is retracted partially and relatively fixed in position for the duration of the journey. This is because the boundary layer separation occurs at a certain water speed and to pull up too much would cause flow separation, and to pull up less than the full amount would waste the self leveling capability of the system. Once the boat reaches near the bottom of the wave trough and the boat becomes more horizontal, the up motion of the trim tab is automatically reduced back to the neutral position. As the boat starts up the wave on the other side of the trough, the bow starts to rise too much and the automatic stabilizer system actuates the rear force ram downward to push the rear of the trim tab to the down position. This downward position tends to raise the stem of the boat and force the bow of the boat downward to thus keep the boat more closely to a horizontal position to lessen the pitching action of the boat caused by the large waves. Thus, the boat is stabilized.

The rolling motion of a boat occurs when the boat is traveling somewhat parallel to the wave crests or diagonally to the wave crests causing a side to side rocking motion of the boat. The trim tabs and automatic control are used to quell this motion also. The automatic control of the trim tabs is used to lift one side of the boat by pushing down on the trim tab on that side and doing the opposite action on the other side of the boat. That is to say, the opposite side has the trim tab is pulled up thus pulling down that side of the boat. This ride stabilization system may have additional benefits to the military by providing a more stable shooting platform for the guns on board.

Figure 9:
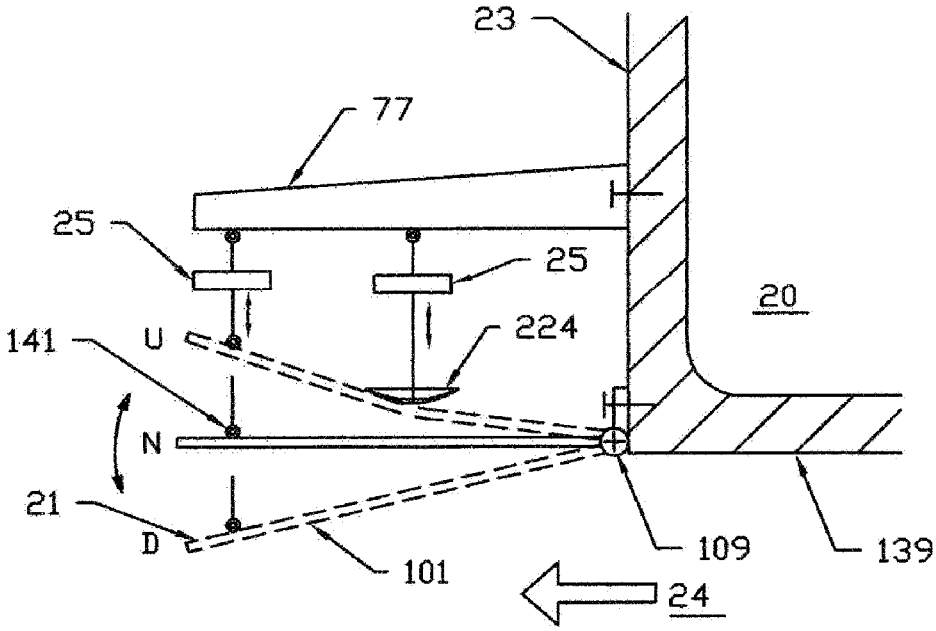
FIG. 9 is a side view of a boat showing a trim tab shape control system according to an embodiment of the present invention similar to that shown in FIG. 8S in which the trim tab is hingedly coupled to the stem of the boat.

FIG. 9 is a side view of a boat 20 showing a trim tab shape control system according to an embodiment of the present invention similar to that shown in FIGS. 8R and 8S in which the trim tab 21 is hingedly coupled to the stern of the boat 20. FIG. 9 is an enlarged view of FIG. 8S and shows in greater detail how the trim tab 21 is flexed in the up position by the rearward force ram 25 pulling upwards and the forward force ram 25 pushes downward on a shoe 224 from a relatively fixed position to cause the trim tab to bend and provide better boundary layer retention. The trim tab 21 is attached to the transom 23 of the boat 20 using a hinge 109. The configuration of FIGS. 8R and 8S is different in that it shows a trim tab 21 which is a cantilevered tab, that is to say, it is mounted solidly to the transom 23 and is not hinged. The advantage of a hinged trim tab is that it may have greater fatigue resistance and allow greater downward deflection without failing due to ductile failure or metal fatigue. The disadvantage of the hinged trim tab is that the point of attachment to the transom 23 forms an abrupt change in the boundary layer and causes the flow to separate at that point. A trim tab shape control system according to the present invention minimizes abrupt change in the boundary layer particularly in the up position, and somewhat decreased in the down position. It is contemplated that the force ram closest to the transom 25 can be retracted to allow the trim tab to actually be straight when in the raised position to cause the boundary water of the water 24 to separate from the trim tab undersurface 101 and thus decrease the drag forces of the water on the trim tab.

Figure 10:
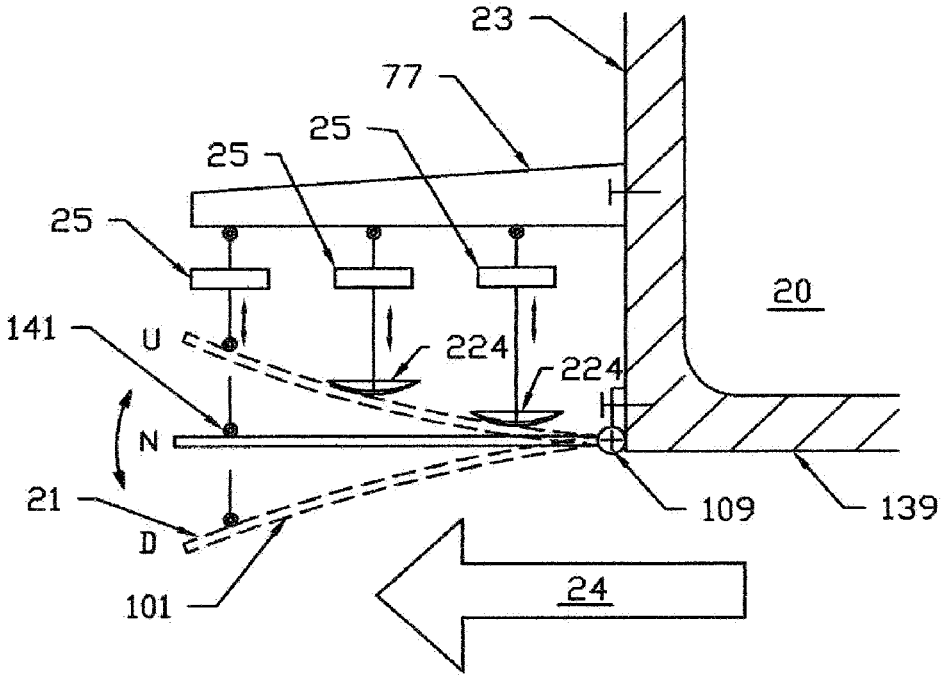
FIG. 10 is a side view of a rear portion of a boat showing a trim tab shape control system according to an embodiment of the present invention similar to that shown in FIG. 9 and including a yardarm attached to the stem of the boat and added force rams to more closely control the curvature of the trim tab.

FIG. 10 is a side view of a rear portion of a boat 20 showing a trim tab shape control system according to an embodiment of the present invention similar to that shown in FIG. 9 and including a yardarm 77 attached to the transom 23 of the boat 23 and added force rams 25 to more closely control the curvature of the trim tab 21. The extra force rams 25 allow a hinged trim tab to operate similarly to that shown and described in von Wolske 812 which has the advantage of a smooth transition at the point of attachment to the transom 23, yet still allows the large amount of motion in the down position (D) of the trim tab. It is clear that the rearward force ram pulls the rear of the trim tab 21 in the up position and the two intermediate force rams 25 forward of the rear ram push down via shoes 224 shown as a rounded nose to impose a set, yet controllable upward curvature on the trim tab 21 to best suit the water flow at any given speed.

FIG. 10 shows one of the unique attributes of a trim tab shape control system in accordance with an embodiment of the present invention. In particular, the shape of the trim tab 21 in the down position becomes curved as the flexible trim tab 21 is bent by the water velocity pressure due to the water 24 impacting the operative bottom surface 101 of the trim tab 21. This is desirable because it causes the water force to manifest itself farther rearward on the trim tab 21, hence giving a greater moment arm for correcting the flight attitude of the boat 20. At low speeds, as shown in FIG. 9, the flexible trim tab 21 is straight, but that is suitable because the boat often does not need much down trim a low speeds. And at low speed, there is not much inertial force available from the water to be applied to the trim tabs anyway.

FIG. 11 is a side view of a boat with a trim tab shape control system implemented according to an embodiment of the present invention which is flexed up and down by a single force ram 25 combined with a regressive flexural stiffness beam acting as a platen 221 to allow greater down trim effects than possible with prior art configurations. In this case the trim tab 21 is shown flexed into the up position. FIG. 11 departs from that shown in von Wolske 812 which teaches a tapered plate trim tab and how the tapered trim tab is flexed up and down by directly attached force rams. The von Wolske 812 system uses the regressive flexural stiffness of the trim tab to describe a curvature in both the up and down position and is limited in the distance of the downward deflection due to the extra stiffness of the trim tab.

Figure 12:
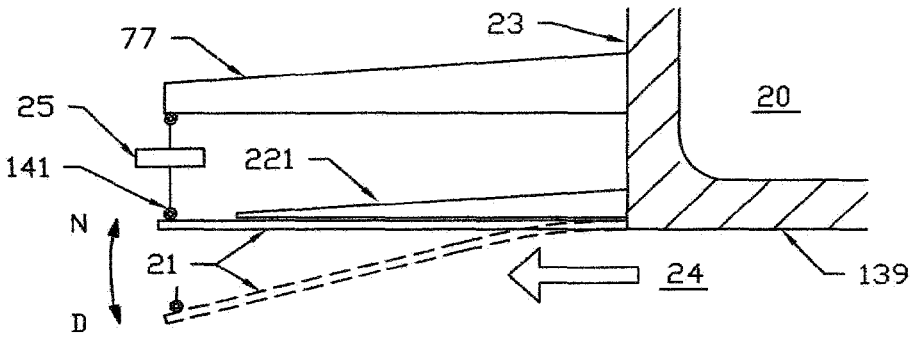
FIG. 12 is a side view of the boat and trim tab shape control system of FIG. 11 in which the trim tab is flexed into the down position relative to the neutral position.

FIG. 12 is a side view of the boat and trim tab shape control system of FIG. 11 in which the trim tab 21 is flexed into the down position relative to the neutral position. The configuration of FIGS. 11 and 12 is similar to FIG. 1 except the trim tab 21 is not hinged at the transom 23, but rather is cantilevered from the transom and may make for an easier installation. However, the cantilevered attachment may result in early fatigue failure or decrease in the range of downward deflection. The curvature of the trim tab shown in FIG. 12 is controlled in the up position by a platen 221 which has a regressive flexural stiffness which has a curvature similar to FIG. 11. The trim tab shape control system of FIGS. 11 and 12 is different from prior art in that the tapered beam does not come into contact with the water and only serves as a mechanical interface to control the curvature of the trim tab and only functions when the trim tab 21 is in the upward position. It is important to note that when the trim tab is in the down position (D), the platen 221 shown as a cantilevered spring above the trim tab 21 is not in play and the shape of the trim tab takes on a totally different shape than that of von Wolske 812. Also, a trim tab shape control system according to embodiments of the present invention anticipates the ability of the trim tab to be flexed much further in the down position, and without failure, than is possible with von Wolske 812.

FIG. 13 is a side view of a boat 20 with trim tab shape control system implemented according to an embodiment of the present invention similar to that shown in FIG. 12 except including a trim tab 21 attached with a hinge 109 allowing greater down trim effects. The hinged embodiments are advantageous in that they allow the trim tab to be forced down even farther, without failure or bending, than is possible with the cantilevered connection. The water 24 is shown flowing under the trim tab 21 at a relatively slow velocity. It is noted that even though the trim tab 21 is flexible, the water does not have enough force to bend the trim tab 21. While FIG. 13 shows a functional equivalent of FIGS. 1 and 2 and others, FIG. 6 through FIG. 25 show the upper anchor point of the force ram 25 as simply a yardarm 77 attached to the transom 23. Note that in the down position, the water 24 is flowing at a slow velocity and the trim tab 21 does not bend.

Figure 14:
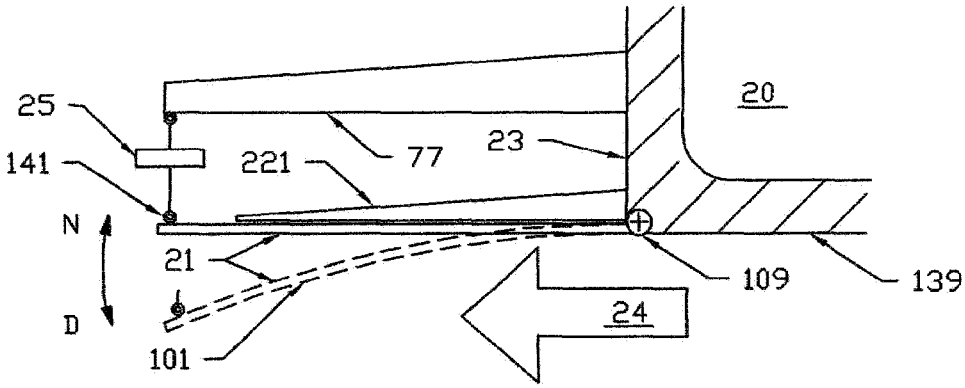
FIG. 14 is a side view the boat and trim tab of FIG. 13 illustrating the bending curvature of the trim tab when experiencing the impact force of the water hitting the bottom of the trim tab when the boat is operating at high speed.

FIG. 14 is a side view the boat 20 and trim tab shape control system of FIG. 13 illustrating the bending curvature of the trim tab 21 when experiencing the impact force of velocity pressure of the water 24 hitting the bottom of the trim tab 21 when the boat 20 is operating at high speed. Note that the arrow 24 is larger illustrating increased water velocity relative to the boat 20. As a result of the high impact forces of the water, the trim tab 21 is actually flexed as though it is bent even though it is attached with the hinge 109 at the transom 23. This flexed curve is advantageous over a flat plate because the hydraulic forces manifest themselves farther back on the trim tab 21 thus giving better stem lift for the equivalent amount of drag force incurred from a flat plate. The impact force of the water causes the trim tab 21 to flex in a curve as shown when the trim tab 21 is in the down position. This curvature is anticipated and is advantageous because it causes the effective force of the water to manifest itself farther back on the trim tab 21, hence on the boat 20, to give a greater moment arm for correcting the flight attitude of the boat 20.

Figure 15:
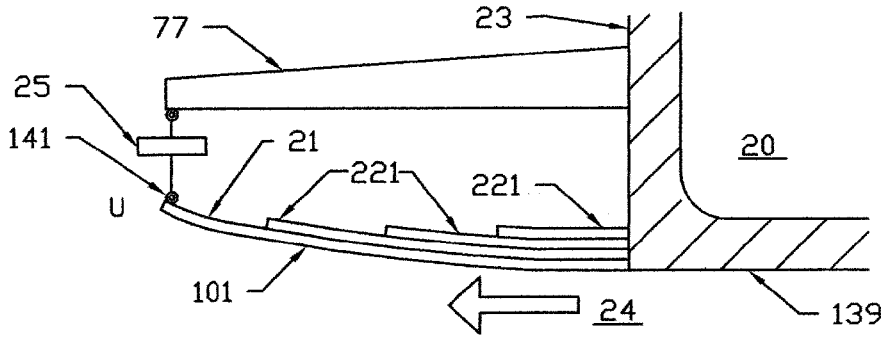
FIG. 15 is a side view of a boat with a trim tab shape control system according to another embodiment of the present invention including a trim tab and a platen configured as a stack of progressively shorter lengths of cantilevered beams of uniform thickness to form a tapered leaf spring.

FIG. 15 is a side view of a boat 20 with a trim tab shape control system according to another embodiment of the present invention including a trim tab 21 and a platen 221 configured as a stack of progressively shorter lengths of cantilevered beams of uniform thickness to form a tapered leaf spring. The trim tab 21 is shown flexed into the up position analogous with that shown in FIG. 11. This is in contrast with that of prior art which employs a trim tab which itself has a regressive flexural stiffness. The cantilevered beams of the platen 221 are not fastened together but collectively form a cantilevered spring which has a different deflection curve in the up position versus the down position.

Figure 16:
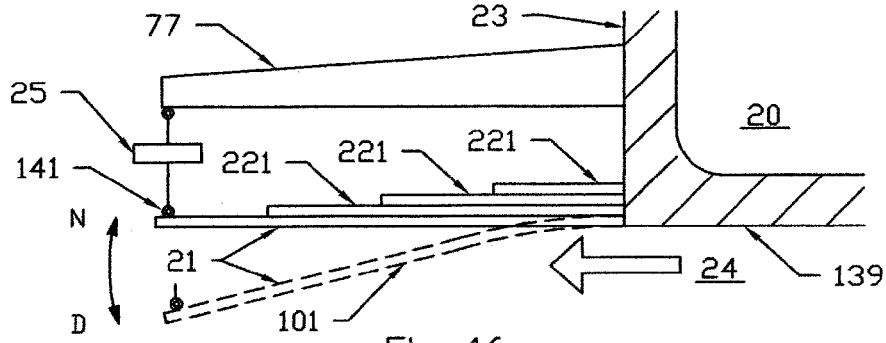
FIG. 16 is a side view of the boat and trim tab shape control system of FIG. 15 illustrating the neutral and down positions of the trim tab.

FIG. 16 is a side view of the boat and trim tab shape control system of FIG. 15 illustrating the neutral and down positions of the trim tab 21. FIG. 16 is an embodiment of present invention similar to FIG. 12 in that the trim tab 21 is separate from the platen 221 above it and the trim tab 21 is able to flex to the down position without the contact or influence of the platen 221 above it. It is clear from FIG. 16 that an appropriately thin trim tab 21 can be bent down with less force, and less fatigue, than possible in prior art configurations.

Figure 17:
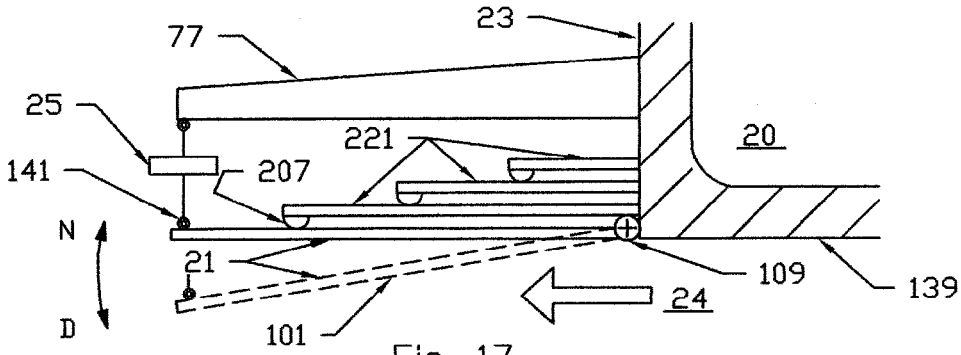
FIG. 17 is a side view of a boat and a trim tab shape control system according to another embodiment of the present invention that is similar to that shown in FIG. 16 in which the cantilevered beams are separated by pads and in which the trim tab is hinged to the transom of the boat.

FIG. 17 is a side view of a boat and a trim tab shape control system according to another embodiment of the present invention that is similar to that shown in FIG. 16 except that each cantilevered beam of the platen 221 includes a pad 207 separating the beams from each other and from the trim tab 21. Also, the trim tab 21 is attached to the transom 23 of the boat 20 with a hinge 109 and the trim tap 21 is flexed into its down position similar to that shown in FIG. 13. The pads 207 are useful to prevent scuffing or galling of the contact parts of the beams which would be a problem if certain galling metals, such as stainless steel or titanium, are used for construction. The contact parts of the beams with the pads 207 may be coated with Teflon® to prevent scuffing or galling. FIG. 17 also shows the hinged trim tab 21 forced into the down position which retains a generally straight shape when the boat is traveling at a slow speed resulting in the water 24 causing a relatively low velocity pressure on the operative bottom surface 101 of the trim tab 21.

Figure 18:
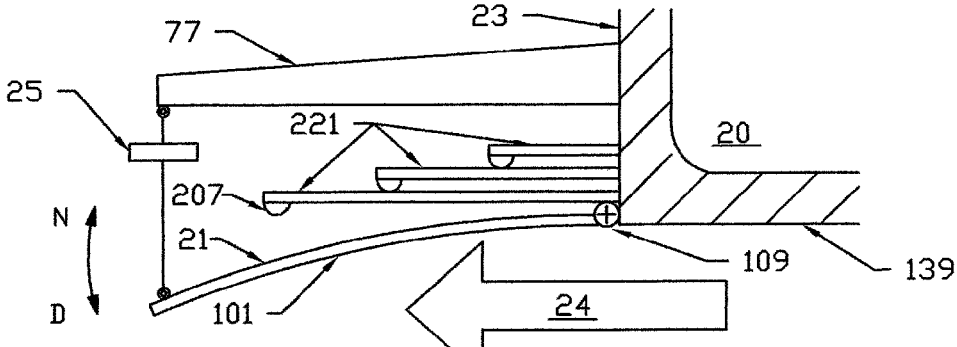
FIG. 18 is a side view of the boat and the trim tab shape control system of FIG. 17 illustrating the bending deflection of the trim tab caused by the impact forces of water when the boat is operating at high speed.

FIG. 18 illustrates the same configuration as that shown in FIG. 17 except showing the water 24 flowing at a relatively high velocity under the trim tab 21 and the impact force of the water velocity pressure causes the trim tab 21 to flex into a curve as shown when the trim tab 21 is forced into the down position. In a similar manner as described for FIG. 14, this curvature is anticipated and is advantageous because it causes the effective force of the water to manifest itself farther rearward on the trim tab 21, hence on the boat 20, to give a greater moment arm for correcting the flight attitude of the boat 20.

Figure 19:
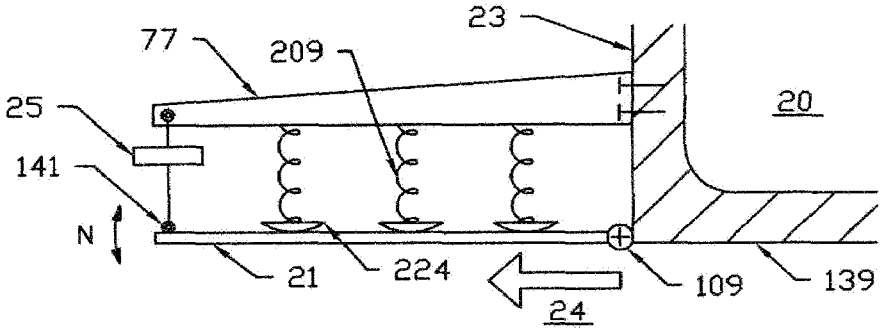
FIG. 19 is a side view of a boat and a trim tab shape control system according to another embodiment of the present invention showing a push and pull force ram at the rear end of the trim tab and several push only springs located along the length of the trim tab.

FIG. 19 is a side view of a boat 20 and a trim tab shape control system according to another embodiment of the present invention showing a push and pull force ram 25 at the rear end of the trim tab 21 and several push only springs 209 located along the length of the trim tab 21. The configuration of FIG. 19 is similar to that of FIG. 17 except the leaf spring is replaced by a series of coil springs 209 placed along the length of the trim tab 21. This is a functional equivalent of FIG. 17 to cause the trim tab 21 to take a progressive curve in the up position and to be allowed to swing freely by means of hinge 109 to the down position. The attachment of the springs 209 and the force ram 25 to the boat is shown by a yardarm 77 which is simply a convenience for the depiction and is no way limiting the means of attachment. The coil springs 209 have shoes 224 to push on the trim tab 21 when the trim tap 21 is pulled to the up position. Each of the coil springs 209 may be implemented with the same stiffness or resistive load etc. (spring load characteristics) or with varied spring load characteristics along the series, such as a progressively increasing or decreasing spring load characteristics from the transom 23 to the ear 141.

Figure 20:
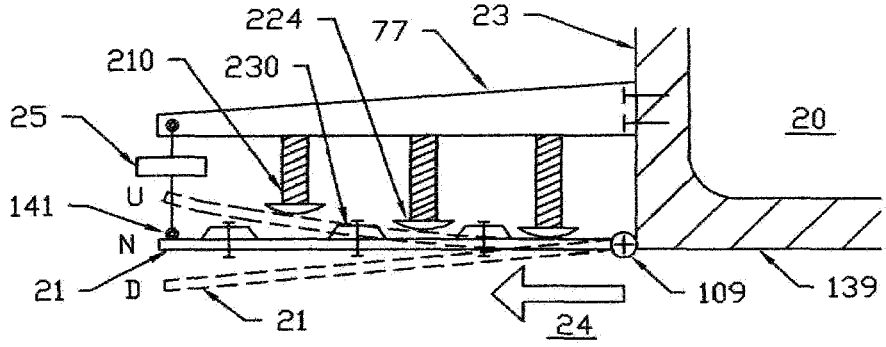
FIG. 20 is a side view of a boat and a trim tab shape control system according to another embodiment of the present invention showing a push and pull force ram at the rear end of the trim tab and several jack screws which limit the upward motion of the trim tab.

FIG. 20 is a side view of a boat 20 and a trim tab shape control system according to another embodiment of the present invention showing a push and pull force ram 25 at the rear end of the trim tab 21 and several jack screws 210 which limit the upward motion of the trim tab 21. FIG. 20 also shows ribs 230 which are placed transverse to the water flow 24 and are used to provide added stiffness in that direction without adding stiffness in the longitudinal direction parallel to the flow of water. FIG. 20 is similar to FIG. 19 except that the coil springs 209 are replaced with jackscrews 210 which are either fixed or manually adjustable to define the curvature of the trim tab 21 in the maximum up position. In an alternative embodiment, the jackscrews 210 are remotely controlled by electric screw motors or the like. The jack screws 210 have shoes 224 to push on the trim tab 21.

Figure 21:
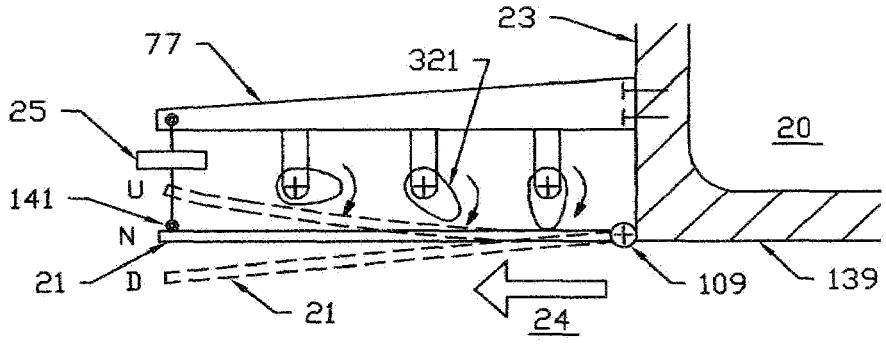
FIG. 21 is a side view of a boat and a trim tab shape control system according to another embodiment of the present invention showing a push and pull force ram at the rear end of the trim tab and several cam shafts which limit the upward motion of the trim tab.

FIG. 21 is a side view of a boat 20 and a trim tab shape control system according to another embodiment of the present invention showing a push and pull force ram 25 at the rear end of the trim tab 21 and several cams 321 which limit the upward motion of the trim tab 21. FIG. 21 is similar to FIG. 20 without the ribs 230 and shows how the upward position of the trim tab 21 is determined by the cams 321 located along the length of the trim tab 21. The cams 321 are rotated to vary the upward travel of the trim tab 21. The cams 321 may be preset to fixed positions (e.g., locked in position) or rotated based on operating conditions. The relative rotational positions of the cams 321 determine the shape of the trim tab 21 in the up position. The cams 321 may be power operated and operated from a remote station. In one embodiment, the cams 321 are long shafts to provide support across the entire width of the trim tab 21. Alternatively, the cams 321 are short and force against load distributing ribs 230 similar to those as shown in FIG. 20.

Figure 22:
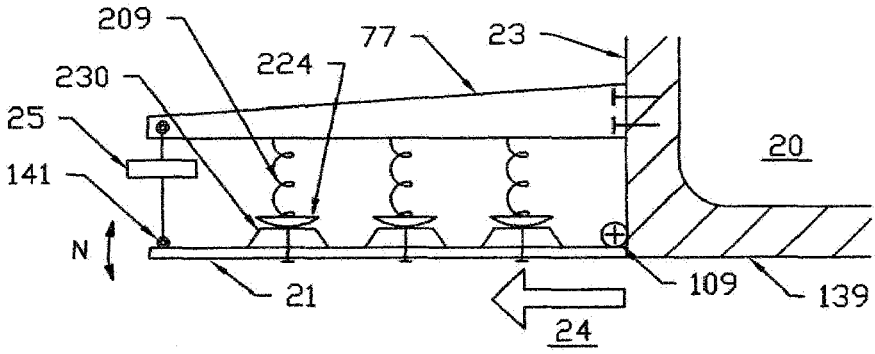
FIG. 22 is a side view of a boat and a trim tab shape control system according to another embodiment of the present invention showing springs similar to that shown in FIG. 19 combined with several ribs mounted transversely to the trim tab to distribute the forces across the trim tab.

FIG. 22 is a side view of a boat 20 and a trim tab shape control system according to another embodiment of the present invention showing springs 209 similar to that shown in FIG. 19 combined with several ribs 230 mounted transversely to the trim tab 21 to distribute the forces across the trim tab 21. FIG. 22 is a combination of the springs 209 of FIG. 19 and the ribs 230 of FIG. 20 operable to distribute the concentrated force of the springs 209 across the width of the trim tab 21. This configuration is particularly useful if the trim tab 21 is of a thin material or is particularly wide such the trim tab 21 would otherwise belly up or belly down somewhere along the mid span between the left side and the right side of the trim tab 21.

Figure 23:
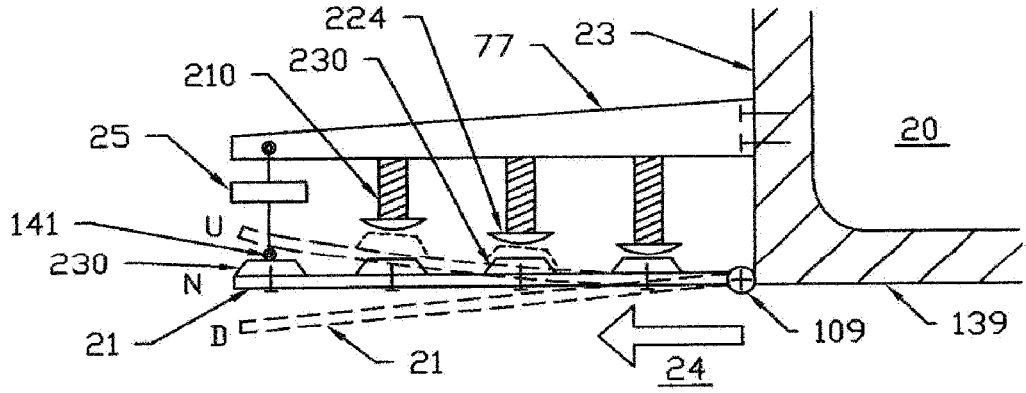
FIG. 23 is a side view a boat and a trim tab shape control system according to another embodiment of the present invention showing jack screws similar to that shown in FIG. 20 combined with several ribs mounted transversely to the trim tab to distribute the forces across the trim tab.

FIG. 23 is a side view a boat 20 and a trim tab shape control system according to another embodiment of the present invention showing jack screws 210 similar to that shown in FIG. 20 combined with several ribs 230 mounted transversely to the trim tab 21 to distribute the forces across the trim tab 21. FIG. 23 is a modification of FIG. 20 in which the ribs 230 are located under the load points of the jackscrews 210 to provide a load distributing means particularly useful on trim tabs 21 made from thin material subject to local deformation, or trim tabs that are particularly wide.

Figure 24:
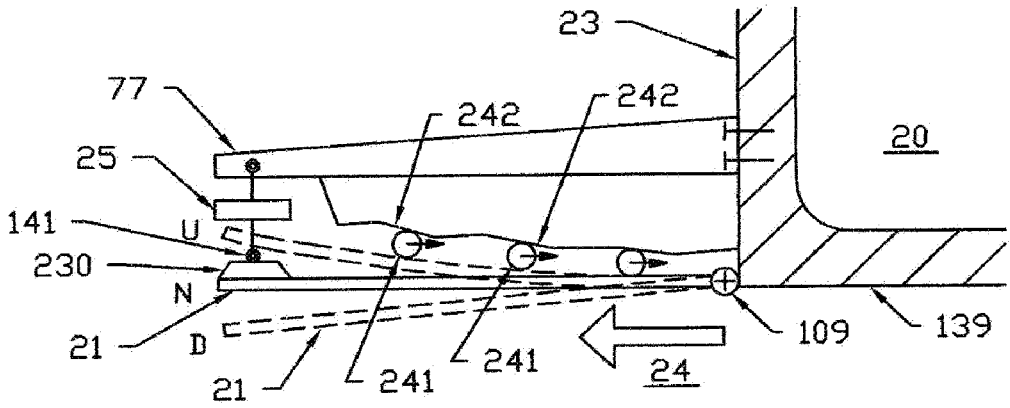
FIG. 24 is a side view of a boat and a trim tab shape control system according to another embodiment of the present invention showing several round rods which slide along ramps as an extension of the yardarm and in which the rods act as stops for the upward motion of the trim tab.

FIG. 24 is a side view of a boat 20 and a trim tab shape control system according to another embodiment of the present invention showing several round rods 241 which slide along ramps 242 as an extension of the yardarm 77 and in which the rods 241 act as stops for the upward motion of the trim tab 21. FIG. 24 is similar to FIG. 21 except the rotating force cams 321 are replaced with the rods 241 that slide on the ramp 242 to move the rods 241 closer or farther from the top side of the trim tab 21. This allows the upward position of the trim tab 21 to be controlled either by manual adjustment or by remote automatic control. This embodiment of a rod sliding up a ramp is robust and provides good transverse stiffness across the width of the trim tab at the line of contact with the rod.

Figure 25:
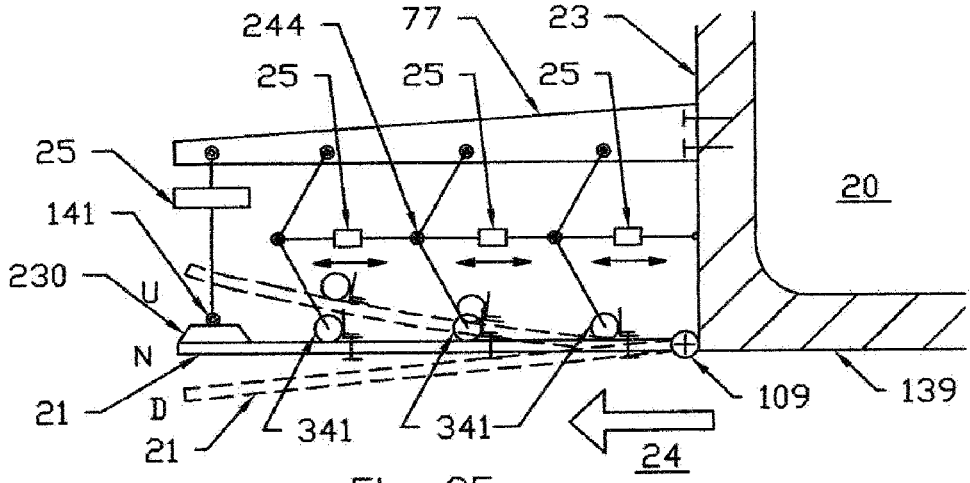
FIG. 25 is a side view of a boat and a trim tab shape control system according to another embodiment of the present invention showing several toggle linkages which are connected to rods across the width of the trim tab in which the toggle position acts as stops for the upward motion of the trim tab.

FIG. 25 is a side view of a boat 20 and a trim tab shape control system according to another embodiment of the present invention showing several toggle linkages which are connected to rollers 341 across the width of the trim tab 21 in which the toggle position acts as stops for the upward motion of the trim tab 21. FIG. 25 is similar to that shown in FIG. 24 except the sliding rods 242 are replaced by toggles 244 that extend via a knee action to control the upward position of the trim tab 21. The toggle linkages are implemented with the toggles 244 and intermediate force rams 25 for positioning the rollers 341 interfacing the trim tab 21. This configuration may be particularly suited to the use of shape memory alloys for the force rams 25. For example, each force ram 25 may be implemented with electrostrictive material having a displacement as a function of electrical energy. It is noted that the first force ram is connected to the transom and each of the successive force rams are connected in series to each of the successive knee joints continuing to the rear of the trim tab. Because of this series connection, the displacement of each knee joint is additive to the one prior to it. This causes the rearward knee joints to actually be flexed more that the forward knee joints and likewise the trim tab be flexed more at the rearward end of the trim tab. This cumulative deflection is particularly suited to the high force and low deflection of shape memory alloys. Shape memory alloys usually require some type of linkage mechanism, for example toggles or levers, in order to generate significant displacements or forces on the hydrodynamic surfaces.

Figure 26:
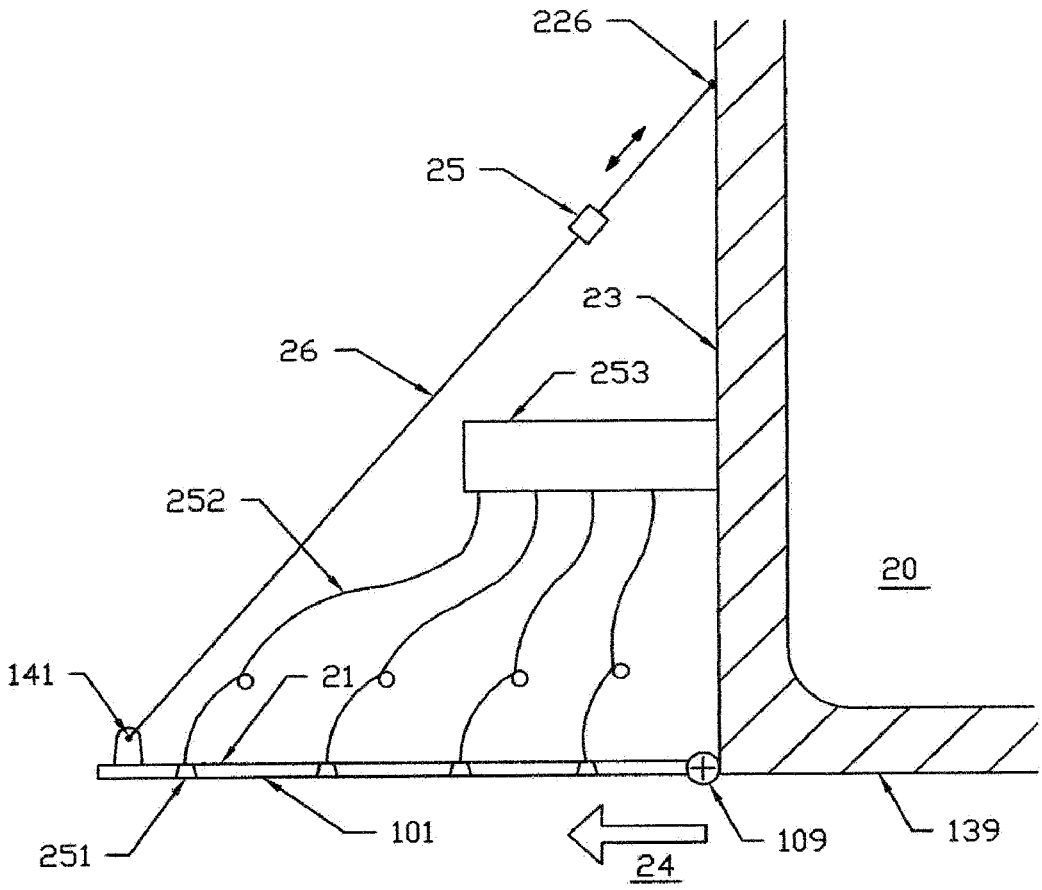
FIG. 26 is a side view of a boat and a trim tab shape control system according to another embodiment of the present invention showing a group of pressure sensing ports drilled through the trim tab and including pressure tubes to a logic box for monitoring the boundary layer pressure under the trim tab.

FIG. 26 is a side view of a boat 20 and a trim tab shape control system according to another embodiment of the present invention showing a group of pressure sensing ports 251 drilled through the trim tab 21 and including pressure tubes 252 to a logic box 253 for monitoring the boundary layer pressure under the trim tab 21. Any of the trim tabs 21 described herein may be modified with the series of pressure sensing ports 251 in communication with the trim tab undersurface 101 of the trim tab 21. These pressure sensing ports sense the prevailing pressure on the trim tab undersurface 101 in the local vicinity of the pressure sensing port and communicate that local pressure to the top side of the trim tab 21. These signals are sent via the communication pipes 252 (e.g., wires, tubes, etc.) to the logic box 253 to be used for monitoring and control of the trim tab 21. This system is particularly useful for adjusting the curvature of the trim tab 21 to optimize its performance and to obviate boundary layer separation problems.

Figure 27:
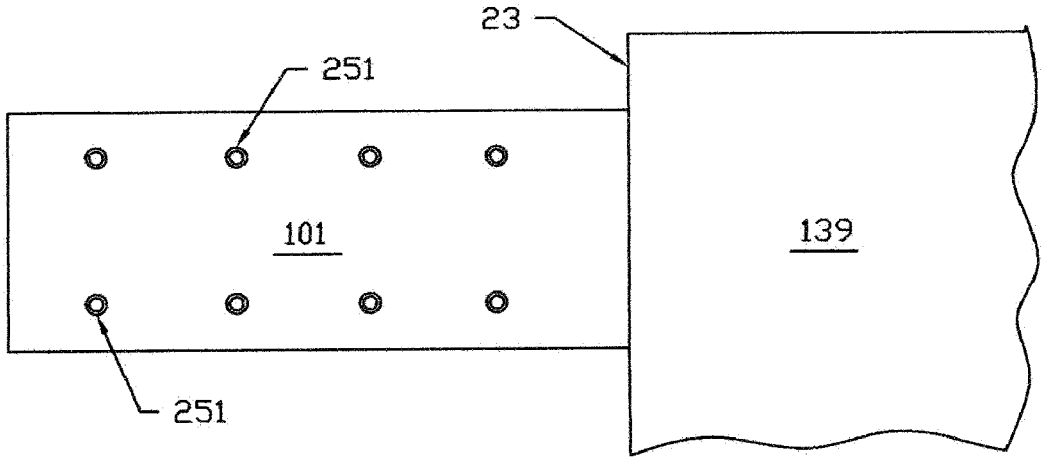
FIG. 27 is a bottom view of the boat and the trim tab shape control system of FIG. 26 and illustrating a two dimensional array of pressure ports distributed across the bottom surface of the trim tab.

FIG. 27 is a bottom view of the boat bottom 139 and the trim tab undersurface 101 of the trim tab 21 of the trim tab shape control system of FIG. 26 and shows that the pressure sensing ports 251 can be formed as a two dimensional array along the flow length and across the width of the trim tab 21.

Figure 28:
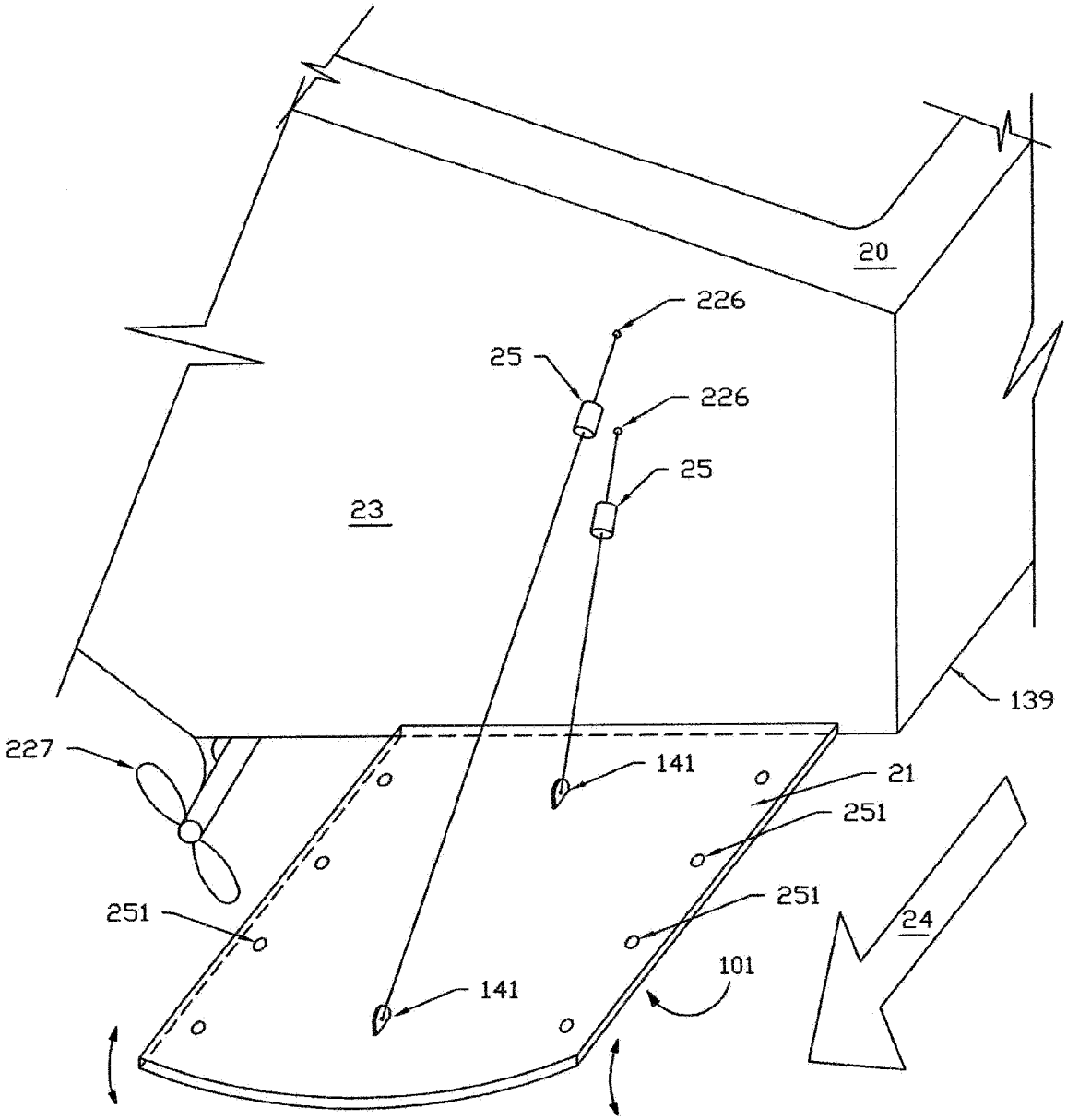
FIG. 28 is a perspective view of the rear right side of a boat illustrating a simplified mechanism according to another embodiment of a trim tab shape control system according to the present invention and similar to that of FIGS. 7R and 7S excluding the yardarm.

FIG. 28 is a perspective view of the rear right side of a boat 20 illustrating a simplified mechanism according to another embodiment of the present invention and similar to that of FIGS. 7R and 7S excluding the yardarm 77. The yardarm attachment is instead shown as a transom 23, which are functional equivalents without diminishing the intent of the invention. The pressure ports 251 are shown included along the edges of the trim tab 21. The forcing rams 25 are designed to both push and pull to control the shape of the trim tab 21. The point of attachment to the trim tab 21 is an ear 141 and can be a vertical piece of metal with a hole through it to accommodate a clevis end of a rod which is part an extension of force ram 25. FIG. 28 shows a simplified version of only two force rams 25 which is suitable for trim tabs 21 that are fairly short in length. The use of a surface drive propeller shaft carrier over the top of the trim tab 21 is blocked by hardware and therefore the arrangement is more suited for other types of propulsion such as the strut mounted side propeller 227. The use of a single point load force ram is suitable if the trim tab is fairly narrow or has sufficient transverse rigidity.

Figure 29:
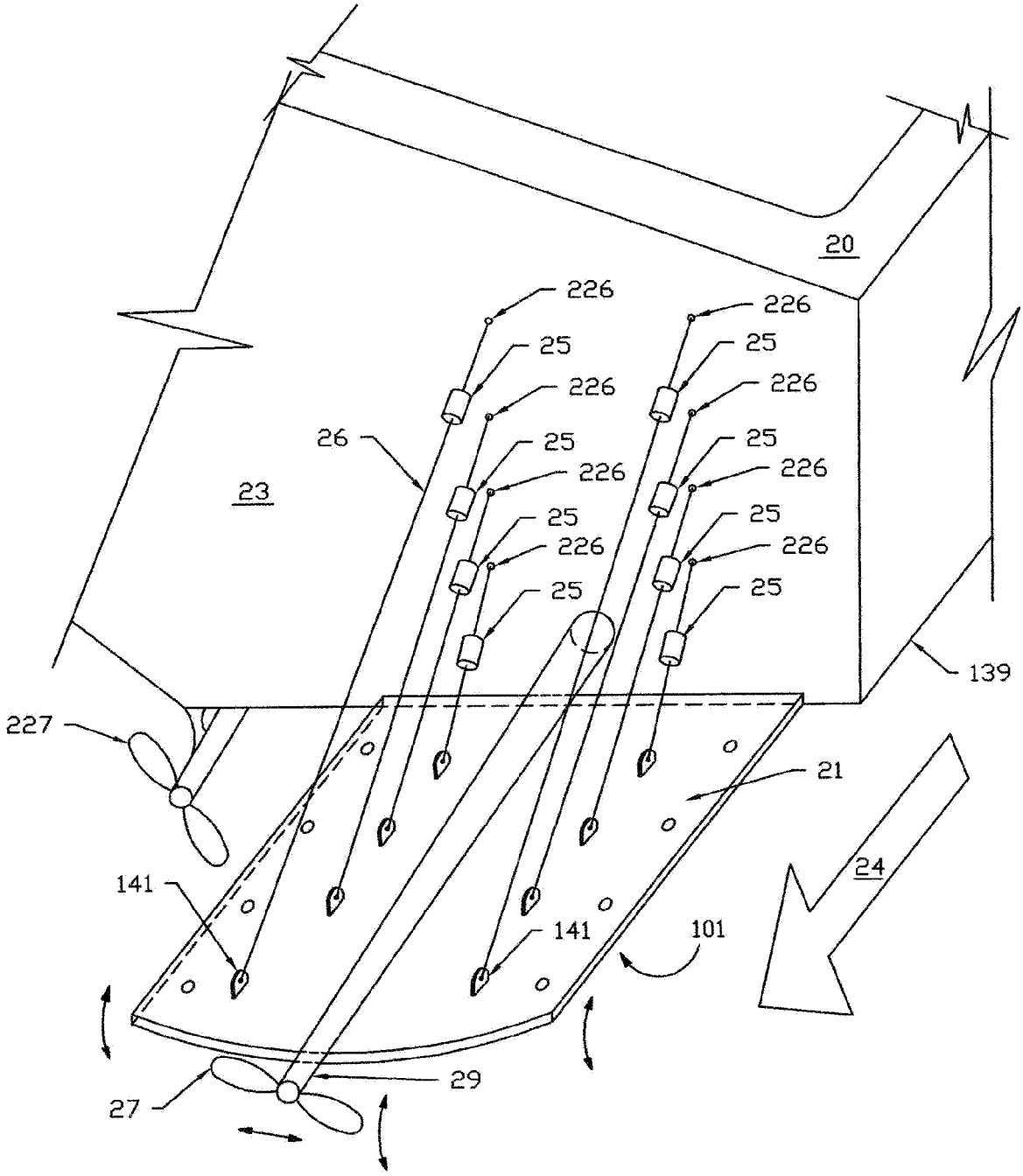
FIG. 29 is a perspective view of the rear right side of a boat and illustrating a trim tab shape control system according to another embodiment of the present invention that is similar to, but more complex than that shown in FIG. 28.

FIG. 29 is a perspective view of the rear right side of a boat 20 illustrating a trim tab 21 with a trim tab shape control system according to another embodiment of the present invention that is similar to, but more complex than that shown in FIG. 28. FIG. 29 anticipates the use of a surface drive propeller shaft carrier 29 over the top of the trim tab 21, such as that shown in FIG. 1. The use of multiple force rams 25 allows the trim tab to be shaped to any up or down curvature and may even be used to pull up on part of the trim tab 21 while pushing down on another part of the trim tab 21. This is useful for imparting some localized hook or rocker in the trim tab 21 or for adding twist to the trim tab 21. The push and pull force of the force rams 25 is transferred to the trim tab 21 via ears 141 mounted thereto.

Figure 30:
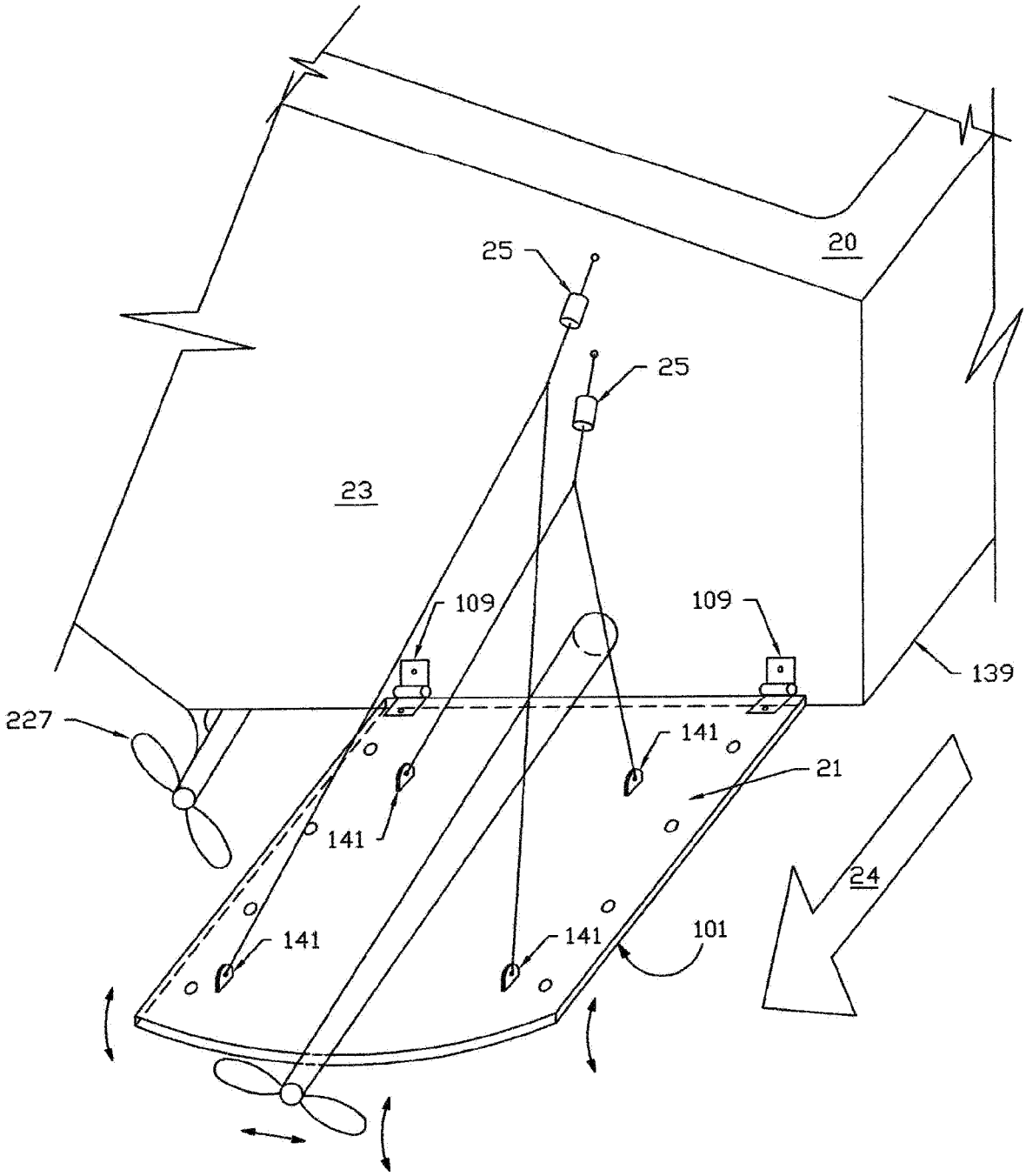
FIG. 30 is a perspective view of the rear right side of a boat and a trim tab shape control system according to another embodiment of the present invention that is similar to that shown in FIG. 28 and including a hinge connection of the trim tab to the transom.

FIG. 30 is a perspective view of the rear right side of a boat 20 and shows a trim tab 21 with a trim tab shape control system according to another embodiment of the present invention that is similar to that shown in FIG. 28 and includes a hinge connection 109 of the trim tab 21 to the transom 23. FIG. 30 is similar to FIG. 9 but the forward force ram 25 can exert both a push and a pull on the trim tab 21 via ears 141 similar to FIG. 29. Note this includes the use of hinges 109 and allows the reduction of the number of force rams by splitting the piston rod into two sections to connect to the right and left side of the trim tab.

FIG. 31 is a perspective view of the rear right side of a boat 20 and illustrating a trim tab 21 with a trim tab shape control system according to another embodiment of the present invention that is similar to that shown in FIG. 29 and including a hinge connection of the trim tab 21 to the transom 23. FIG. 31 is similar to FIG. 29 but includes hinges 109 to mount the trim tab 21 to the transom 23. This allows greater down motion of the trim tab 21 without causing failure by fatigue or bending. FIG. 31 is similar to FIG. 7 and is similar to FIG. 10 but has push and pull capability on all force rams 25.

Figure 32:
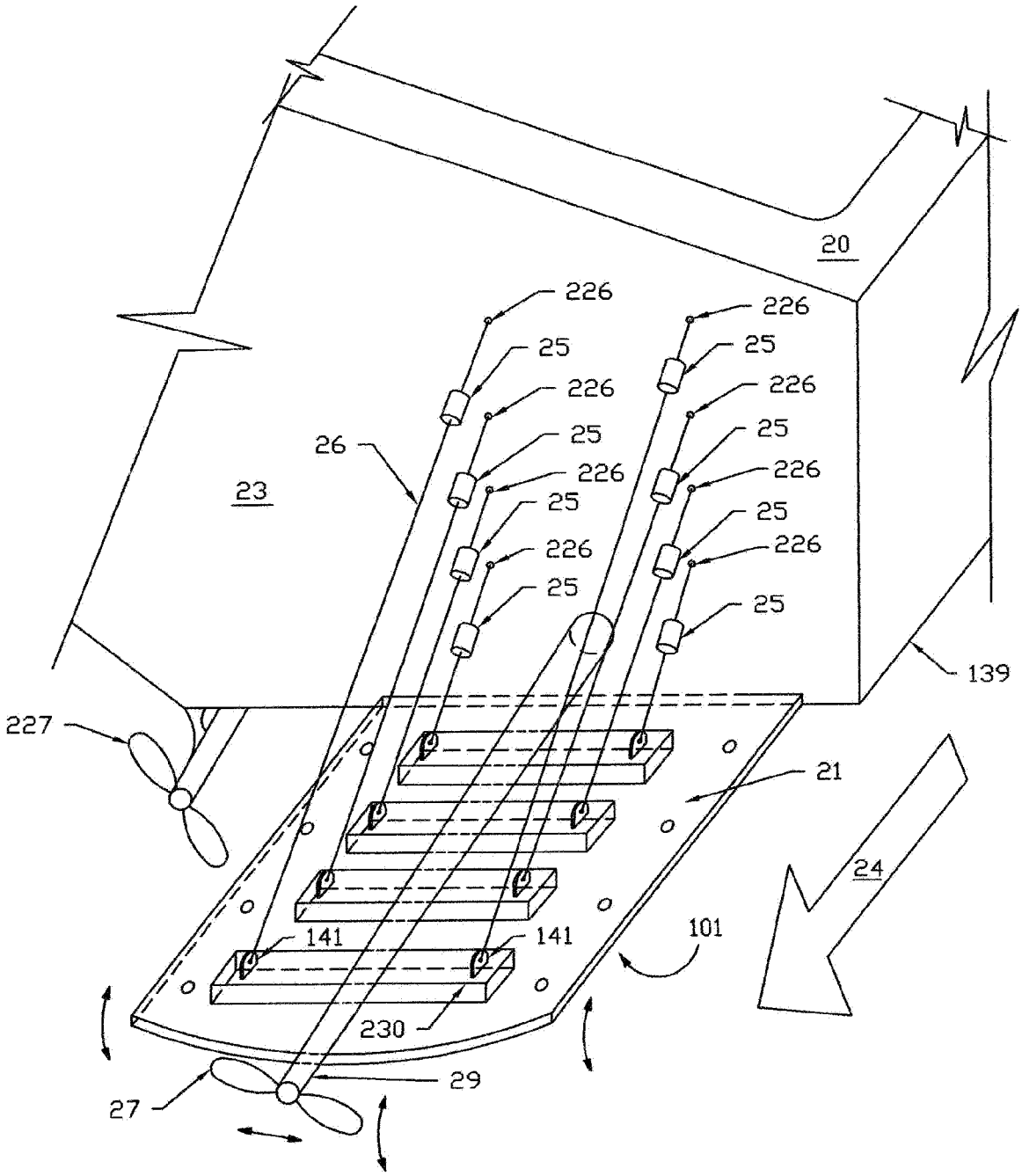
FIG. 32 is a perspective view of the rear right side of a boat and illustrating a trim tab shape control system according to another embodiment of the present invention that is similar to that shown in FIG. 29 including the use of ribs on the trim tab to distribute forces across the trim tab.

FIG. 32 is a perspective view of the rear right side of a boat 20 illustrating a trim tab 21 with a trim tab shape control system according to another embodiment of the present invention that is similar to that shown in FIG. 29 and includes the use of ribs 230 on the trim tab 21 to distribute forces across the trim tab 21. The ribs 230 are transverse or crossways to the water flow 24 passing under the trim tab 21. The ribs 230 help to distribute the bending effect across the width of the trim tab 21 and are similar to the ribs as shown in FIGS. 20, 22, and 23.

Figure 33:
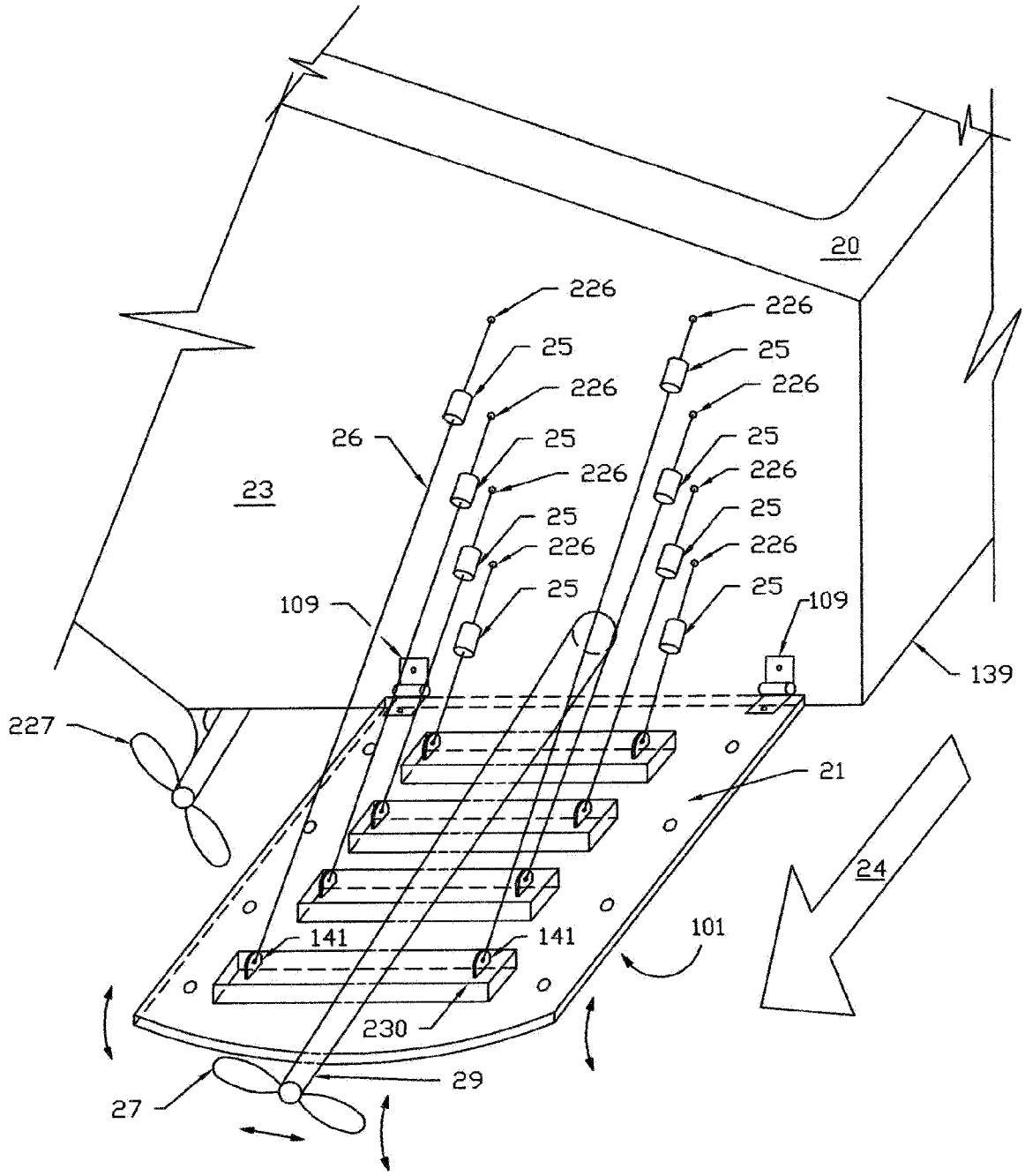
FIG. 33 is a perspective view of the rear right side of a boat and illustrating a trim tab shape control system according to another embodiment of the present invention that is similar to that shown in FIG. 32 and further including a hinged connection of the trim tab to the transom.

FIG. 33 is a perspective view of a boat 20 and a trim tab shape control system similar to that shown in FIG. 32 but having a hinge 109 which fastens the trim tab 21 to the transom 23. This allows for greater up and down motion to minimize failure by fatigue or bending. A greater upward motion may be advantageous for getting a boat 20 off the beach when the other versions of trim tabs have embedded themselves in the sand. With this embodiment, the trim tab 21 can be raised way up to allow the trim tab 21 to act as a ski to slide up and over the sand when the boat 20 is pulled backwards off the beach. This is also advantageous to allow the boat to be skidded across solid surfaces like ramps without harming the trim tab 21.

Figure 34:
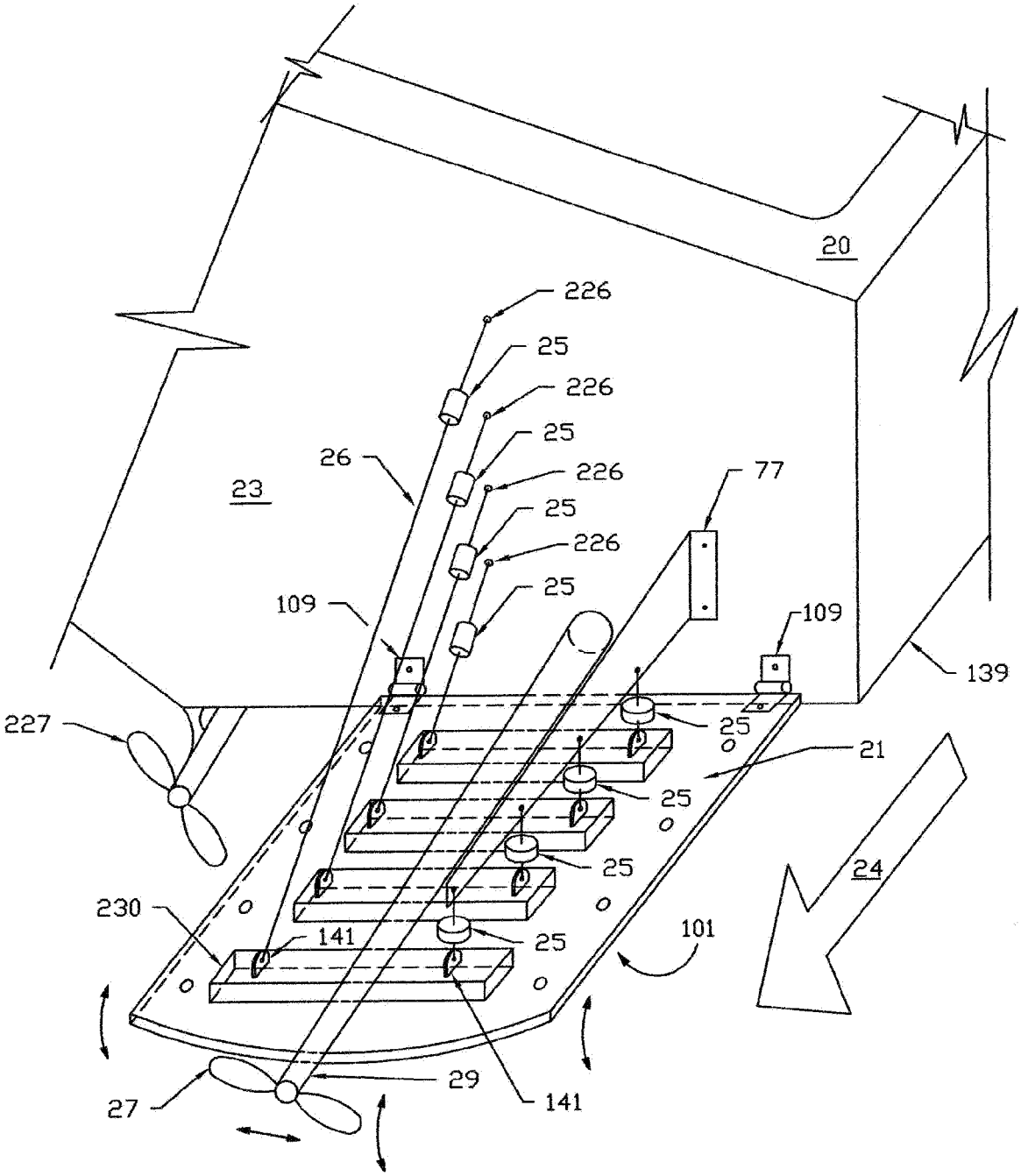
FIG. 34 is a perspective view of a boat and a trim tab shape control system according to another embodiment of the present invention similar to that shown in FIG. 33 and including a yardarm extending from the transom on the right side of the trim tab (the yardarm is a functional equivalent of the transom mounted force rams shown on the left side of the trim tab, a simplified version of the yardarm is shown in FIGS. 7R and 7S)

FIG. 34 is a perspective view of a boat and a trim tab shape control system according to another embodiment of the present invention similar to that shown in F*igure* 33 except illustrating how a yardarm 77 is used to mount the force rams 25. Only one side of the trim tab 21 shows the yardarm 77 compared to the transom 23 mounted force rams 25 and was shown as such to emphasize the functional equivalence of FIG. 7 and also by the same engineering logic it extends to FIG. 19 through FIG. 25.

Figure 35:
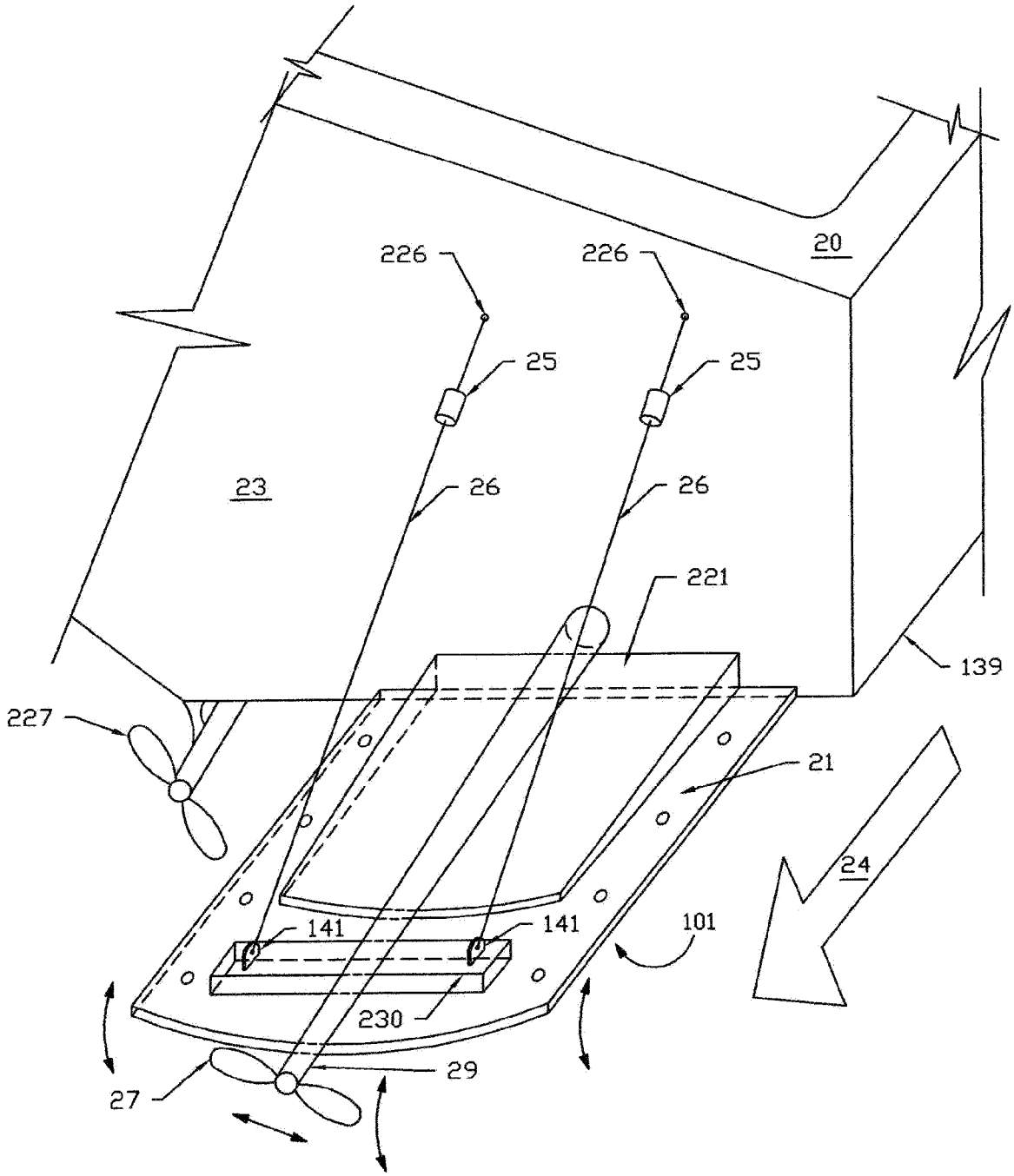
FIG. 35 is a perspective view of a boat and a trim tab shape control system according to another embodiment of the present invention that is similar to that shown in FIG. 1 in which the hinged connection of the trim tab is replaced with a cantilever connection to the transom (similar in function to that shown in FIG. 12)

FIG. 35 is a perspective view of a boat 20 and a trim tab shape control system according to another embodiment of the present invention that is similar to that shown in FIG. 1 in which the hinged connection of the trim tab 21 is replaced with a cantilever connection to the transom 23. FIG. 35 is similar to FIG. 12 but also shows a rib 230 on the trim tab 21. The tapered spring cantilevered from the transom 23 is another form of platen 221 that controls the upward curvature of the trim tab 21 but allows the trim tab 21 to swing free in the down stroke.

Figure 36:
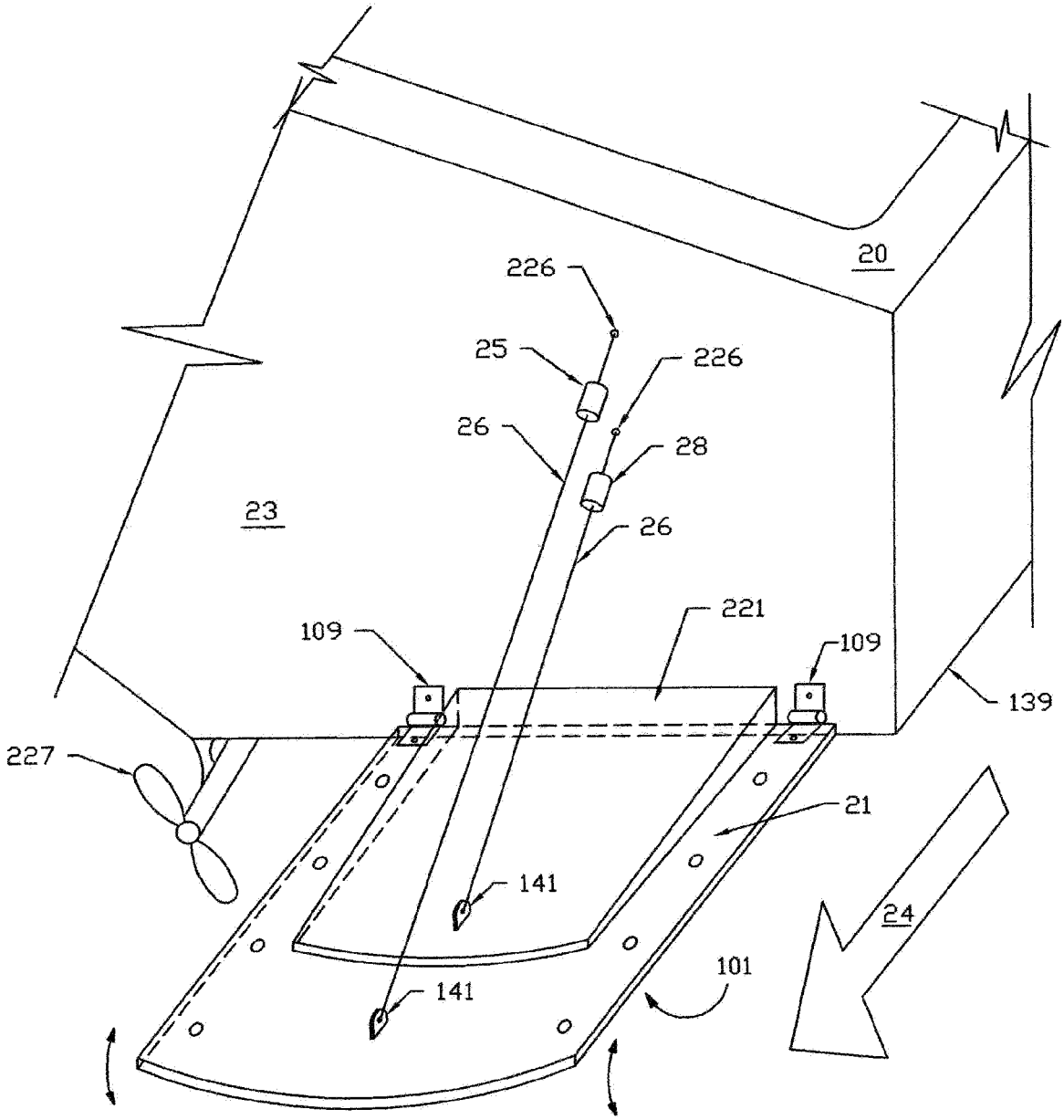
FIG. 36 is a perspective view of a boat and a trim tab shape control system according to another embodiment of the present invention that is similar to that shown in FIG. 35 and including a force ram to the platen, and is more suited for boats with narrow trim tabs.

FIG. 36 is a perspective view of a boat and a trim tab shape control system according to another embodiment of the present invention that is similar to that shown in FIG. 35 and including a force ram to the platen, and is more suited for boats with narrow trim tabs. A hinge 109 is shown connecting the trim tab 21 to the transom 23 to allow the trim tab 21 to swing down freely to reduce the possibility of breaking due to fatigue or bending. FIG. 36 is similar to FIG. 13 and FIG. 14 but also includes a force ram 25 to exert an up or down force on the tapered spring platen 221. The rib 230 of FIG. 35 is also omitted. The use of a single point load force ram is suitable if the trim tab 21 is fairly narrow or has sufficient transverse rigidity.

Figure 37:
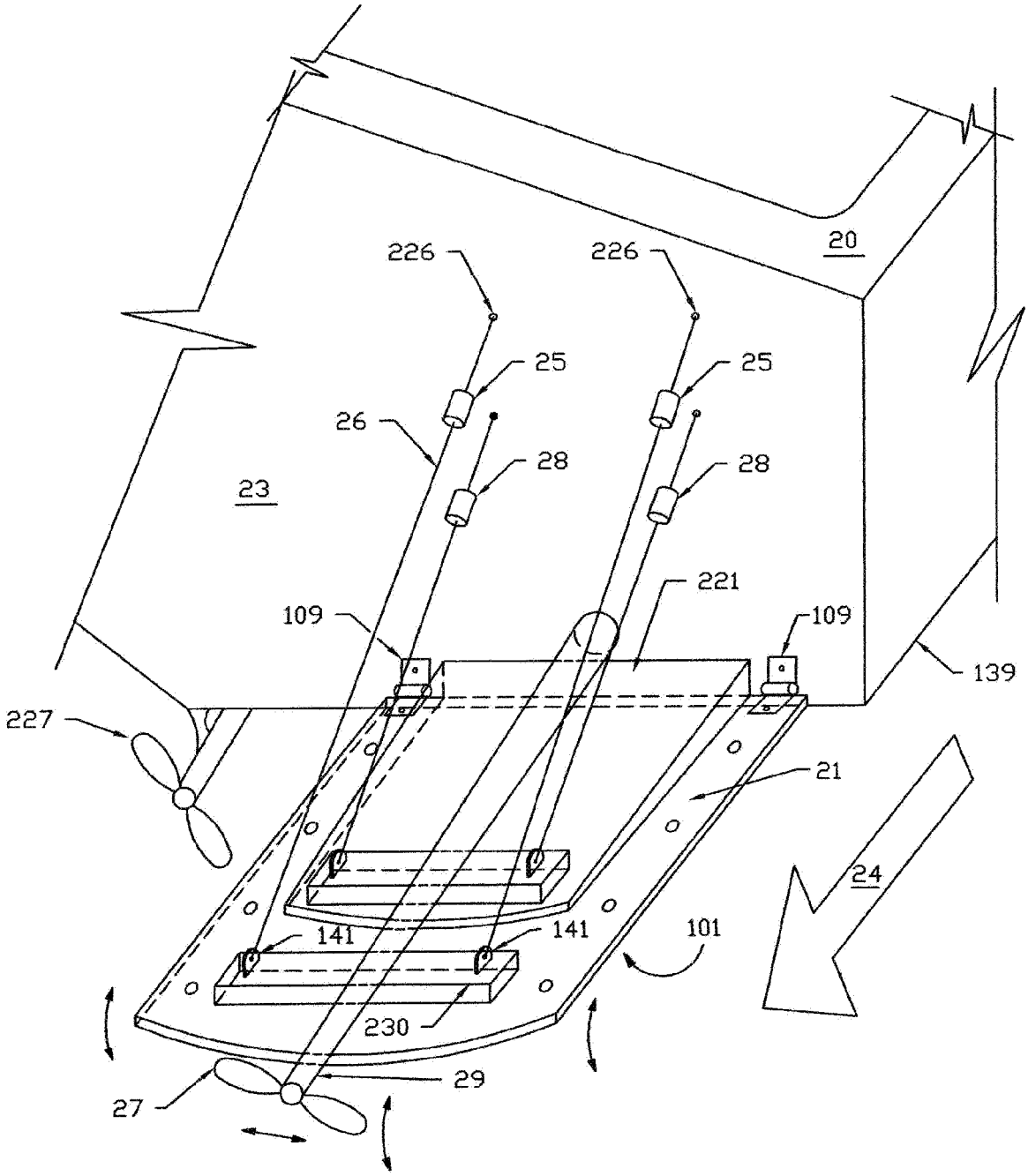
FIG. 37 is a perspective view of a boat and a trim tab shape control system according to another embodiment of the present invention that is similar to that shown in FIG. 1 and including a pair of force rams to the platen (functionally similar to a wider version of the trim tab of FIG. 36)

FIG. 37 is a perspective view of a boat and a trim tab shape control system according to another embodiment of the present invention that is similar to that shown in FIG. 1 but shows an extra force ram 25 attached via a rib 230 to the tapered spring platen 221. This may be advantageous in practice because the tapered spring platen generally requires high forces with small motions and conversely, the trim tab 21 may require low forces with large displacements and thus require two different hydraulic force ram 25 selections.

Figure 38:
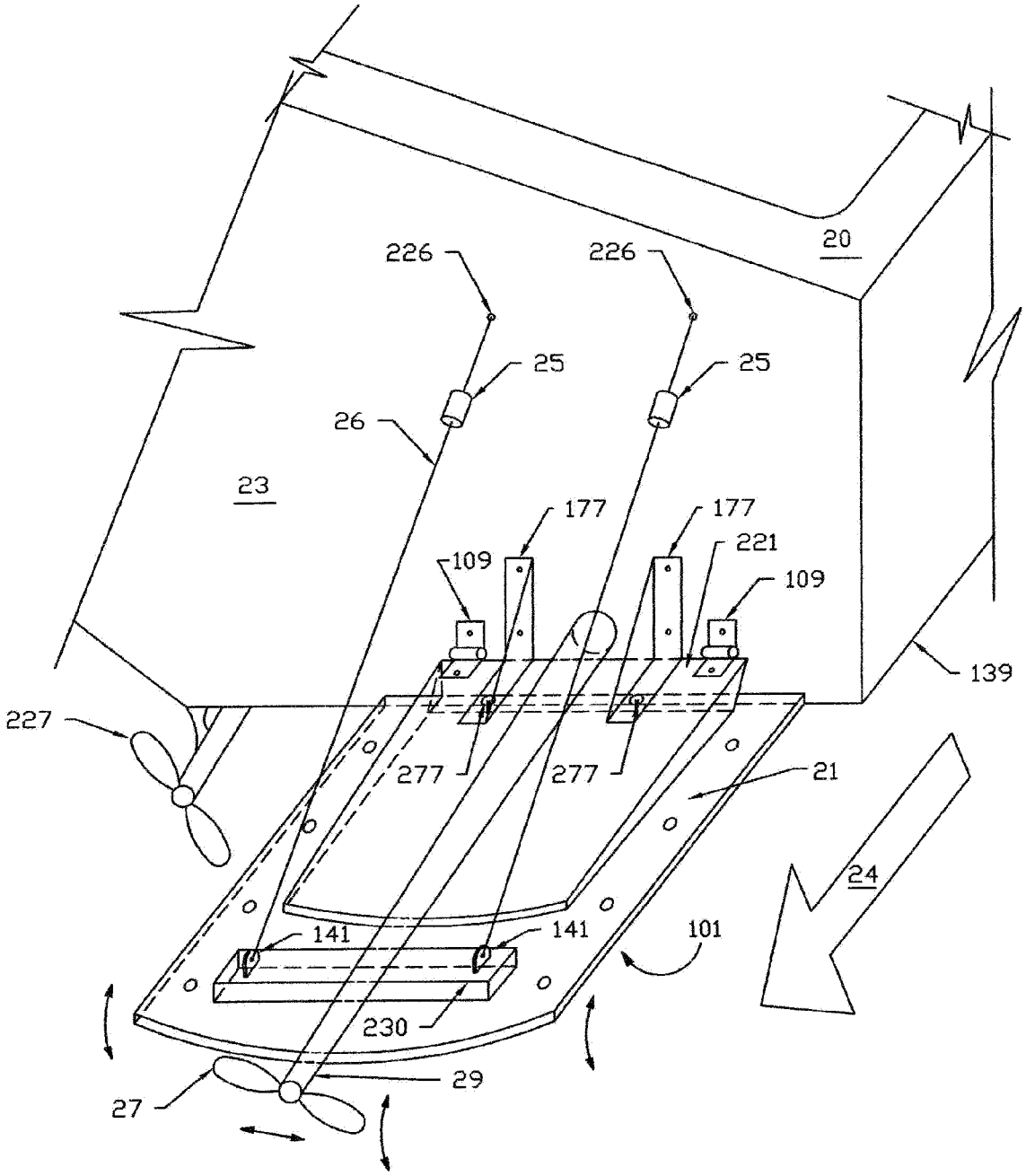
FIG. 38 is a perspective view of a boat and a trim tab shape control system according to another embodiment of the present invention that is similar to that shown in FIG. 35 including a hinge to connect the platen to the transom and a backstop to adjust the position of the platen.

FIG. 38 is a perspective view of a boat and a trim tab shape control system according to another embodiment of the present invention that is similar to that shown in FIG. 35 with the addition of at least one hinge 109 connecting the tapered spring platen 221 to the transom 23 and at least one backstop 177 limiting the upward motion of the tapered spring platen 221 by an adjustment screw 277. This configuration allows the spring platen to be rather simple in construction and operation. This configuration also allows the installed position of the platen to be adjusted as necessary as an improvement over FIG. 35.

Figure 39:
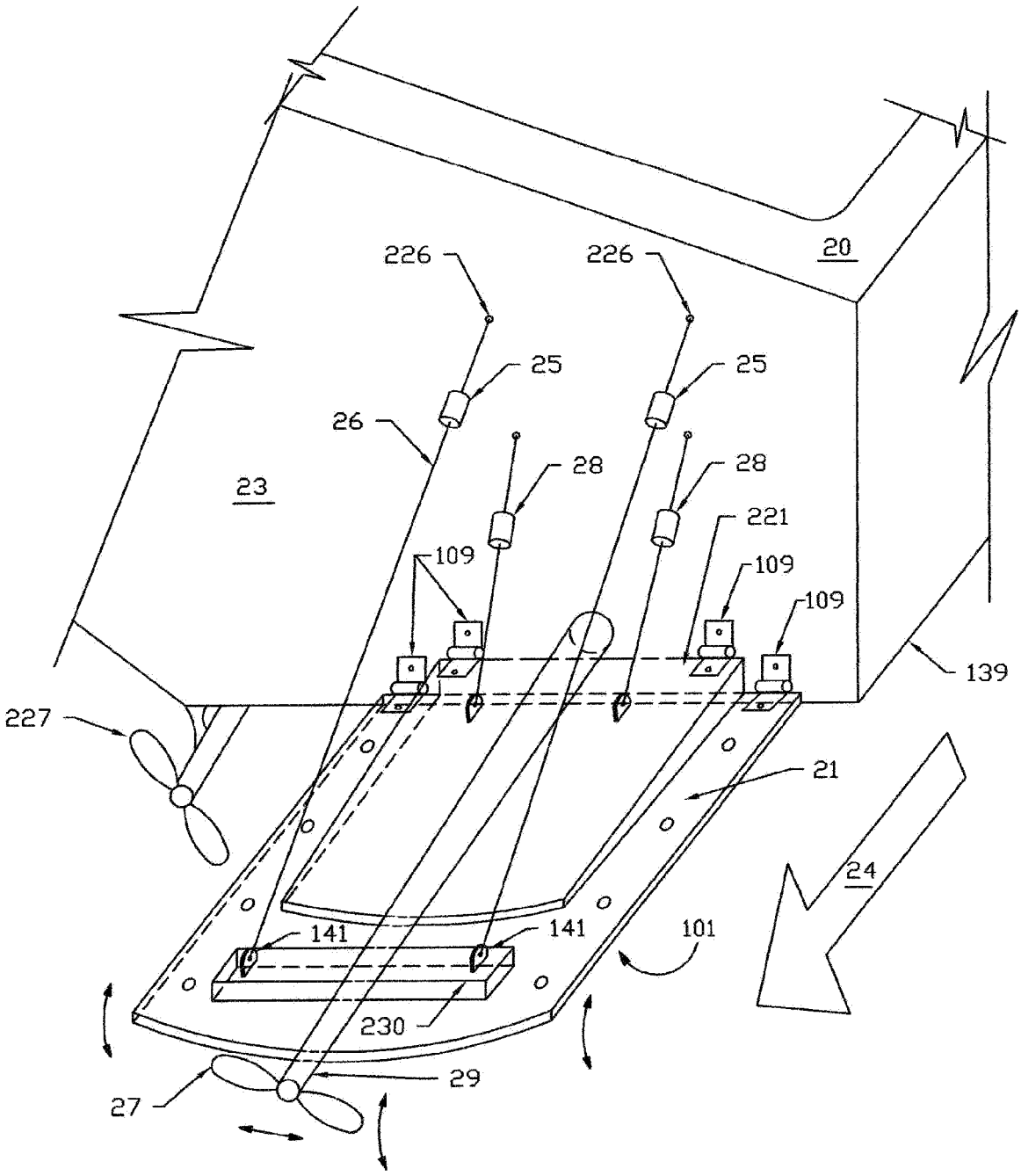
FIG. 39 is a perspective view of a boat and a trim tab shape control system according to another embodiment of the present invention that is similar to that shown in FIGS. 37 and 38 showing a force ram in place of a backstop to control the location of the platen and including a hinge to connect the trim tab to the transom.

FIG. 39 is a perspective view of a boat and a trim tab shape control system according to another embodiment of the present invention that is similar to that shown in FIGS. 37 and 38 except the force rams 25 attached to the platen 221 have been moved towards the transom 23 and the platen 221 is attached to the transom by hinges 109. This embodiment allows the platen 221 to be adjusted as shown in FIG. 38, but allows this adjustment to be done remotely. This embodiment is particularly useful to allow the entire external mechanism comprised of trim tab, platen, and propeller shaft carrier to be swung up vertically to protect it from harm when beached or transported. This system can allow the entire external mechanism to be raised to approximately 45 degrees above the plane of the boat bottom 139.

The configuration of FIG. 39 provides a useful advantage in that the boat 20 can be more easily coaxed back into the water when beached as the up raised trim tab now acts as a skid ramp and slides up easily over the sand below. It is also contemplated that the trim tabs 21 are sufficiently strong and the force rams have sufficient force, that they can work together to actually lift the entire rear end of the boat 20 into the air and allow water to rush in under the boat 20 to break the suction and lubricate the hull for ease of launching the boat 20 when stuck on the beach. This could be useful to the military when the soldiers have to launch a boat at low tide by having the trim tabs 21 and platen 221 raise the boat up to allow the insertion of logs or skids under the hull to roll it back into the water.

The configuration of FIG. 39 also has the advantage of being able to absorb the impact of the boat 20 being dropped at an angle on the trim tabs 21 because the force rams 25 and the platen rams 28 have a release mechanism or a collapse mechanism that allows the entire external mechanism comprised of trim tab, platen, and propeller shaft carrier to be slammed upward without damage. This release mechanism is not shown because it can be one of several well known overload releases common to the particular type of force mechanism used. For example a shear pin can be used on mechanical screws and a relief valve can be used on hydraulic rams. This release mechanism is useful for protecting the trim tab if the boat is dropped onto a hard surface, or if it slams down hard on the water from jumping waves, or if it plunges down hard on a submerged object like a piling or adjacent boat part due to the rise and fall of wave action.

Figure 40:
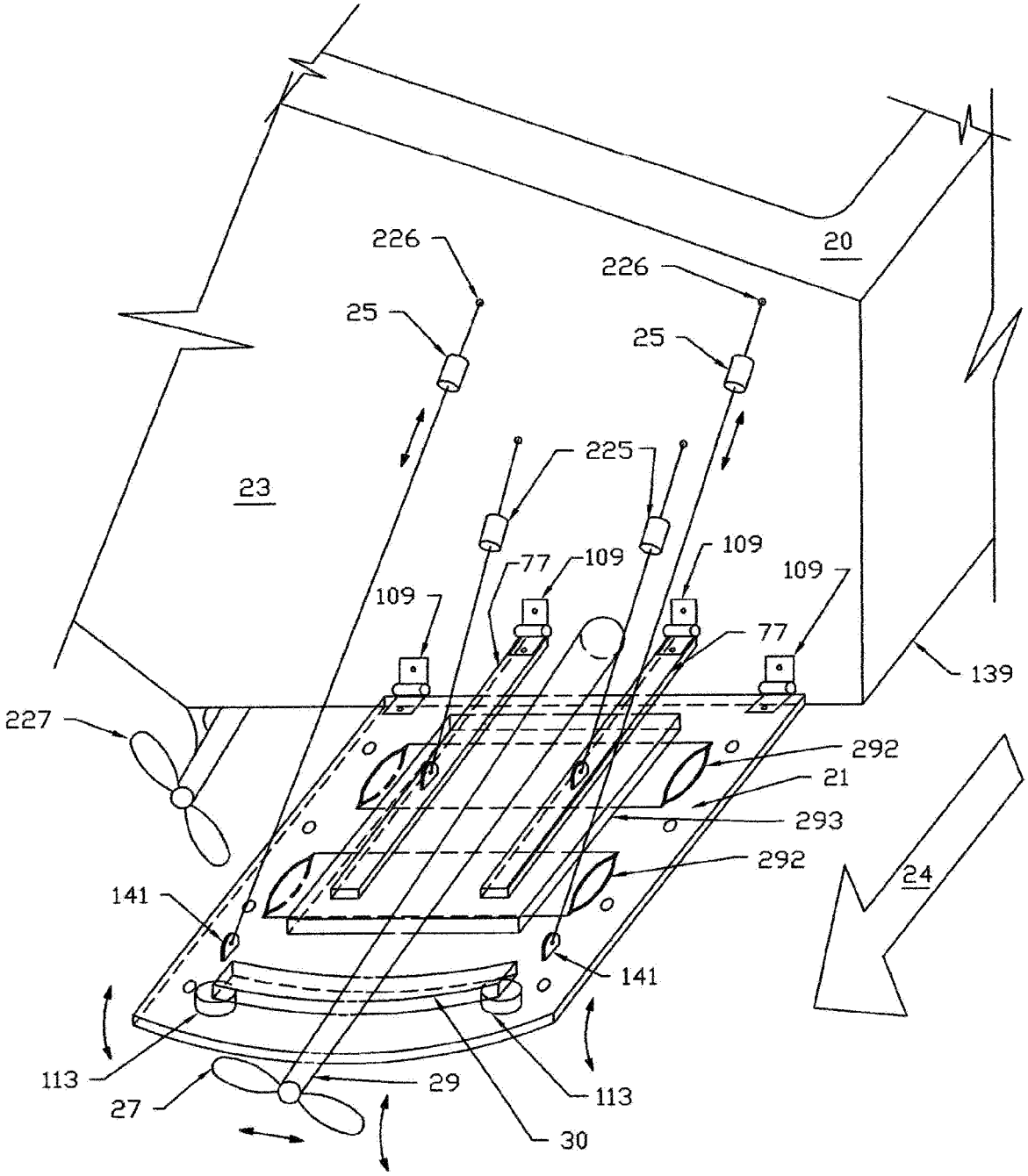
FIG. 40 is a perspective view of a boat and a trim tab shape control system according to another embodiment of the present invention that is similar to that shown in FIG. 39 without the platen and instead showing a yardarm hinged to the transom and positioned by a force ram connected to the transom, and showing bladders used to control the curvature of the trim tab and a propeller bite control mechanism attached to the rear end of the trim tab.

FIG. 40 is a perspective view of a boat 20 and a trim tab shape control system according to another embodiment of the present invention that is similar to that shown in FIG. 39 without the platen 221 and instead showing a yardarm 77 hinged to the transom 23 and positioned by a force ram 25 connected to the transom 23, and showing bladders 292 used to control the curvature of the trim tab 21 and a propeller bite control mechanism attached to the rear end of the trim tab 21. The platen 221 is thus replaced with a series of new technology force generating mechanism that is suitable for small displacement and large forces. It is desirable that these devices also be resistant to biological fouling. For example, one type of force ram includes bladders 292 that are filled with fluid to cause them to swell up and thus control the shape of the trim tab 21. These bladders are similar to a flattened hose that is sealed on the ends and inflated from a pressurized fluid source. A board 293 is attached to the yardarms 77 and serves to distribute the force of the bladders out over a larger area and transfer the force to the yardarms. The yardarms of this embodiment are secured to the transom 23 by the use of hinges 109. Diagonal bracing from the transom to the yardarm is accomplished by yardarm braces 225 which are adjustable. These adjustments may be any of several linear actuators including turnbuckles, jack screws, and hydraulic rams common to the industry. This combination of yardarm and yardarm braces can be swung upward very much like the retractable platen of FIG. 39. The difference in FIG. 40 is that the shape of the trim tab 21 is more controllable than that of the platen in FIG. 39 which is simply a passive design consisting of a tapered flat spring of regressive flexural stiffness.

The use of these bladders 292 is attractive because they are resistant to the effects of biological fouling and require less operating pressure than standard hydraulic rams because of their large effective area. This large area also obviates the need for load distributing ribs on the trim tab 21 as shown in other embodiments. The bladders can be replaced by other means such as piezoelectric stacks which change height as voltage is applied to the device. Other means include the airplane wing deicing technology of magnetostrictive and electrostrictive devices that change dimensions when energized.

Still other means include Shape Memory Alloys (SMA) which are alloys that change shape when energized with electricity. It is simply a block of metal that can generate significant deflections with large forces. Shape Memory Alloys are currently being used to change the shape of discharge nozzles and blade shrouds on marine propellers. SMA's generate large forces over small displacements and may eventually evolve to be most suitable for present invention. It is intended that any of these actuators can be used as force rams 25, or platen rams 28, or yardarm braces 225, in any of the previously discussed embodiments and may prove to be superior as the technology evolves. The use of SMA is a technology particularly attractive to present invention in that it has no moving parts and has a response time of about 1 second. The use of SMA will become even more attractive as the useable strain deflection coefficients become greater than what is available with current technology.

The yardarm 77 is hinged 109 to the transom 23 which thus allows the entire trim tab to swing up a large distance from the plane of the bottom of the boat. This swing up feature is advantageous for pulling the boat back into the water as this allows the trim tab to ski up over the sand on the beach and makes the task of launching much easier than trying to pull the boat backwards with the sharp corner of the transom digging into the sand. It is also contemplated that the yardarm brace 225 can push down on the trim tab sufficiently hard and with enough displacement to actually lift the stern of the boat off from the sand and allow water to wash in to break the suction holding the boat on the beach. This swing up feature is also advantageous for transporting the boat because it allows the propellers and trim tabs to be raised out of harms way and also shortens the overall length of the boat. As in FIG. 39, the actuators have release mechanisms that protect the apparatus from impact damage.

In FIG. 40, the force rams 25 are connected to the trim tab 21 by ears 141 such that stroking the length of the force rams enables the trim tab to swing down on a hinge 109 mounted to the transom 23. This hinge attachment of the trim tab to the transom is also shown in FIG. 10, FIG. 14 and FIG. 18. This large motion allows the trim tab mechanism to help stabilize the boat by quelling the roll and pitch motions in large waves.

FIG. 40 also shows a bite bar 30 and two bite rams 113 mounted to the top rearward surface of the trim tab 21 and is used to control the depth of immersion of the propeller 27. The bite bar provides a surface for the propeller shaft carrier 29 to ride on as it sweeps left and right in a steering motion. Each bite ram 113 can be controlled independently to allow the propeller to bite deeper on one side of the trim tab than on the other side as may be desirable for better steering control of the boat. The bite bar 30 can be made of flat material stock, but is cut on a radius on the rearward and forward edge. By twisting the bite bar about the horizontal transverse axis of the boat, the propeller shaft carrier 29 will either slump down in the middle of the steering sweep motion or hump up in the middle of the steering sweep motion. This is called swoop or soar and allows the propeller to bite more or less water depending upon where the steering direction is pointed. This feature may be advantageous for loading or unloading the propeller 27 when making severe turns to the left or to the right.

Figure 41:
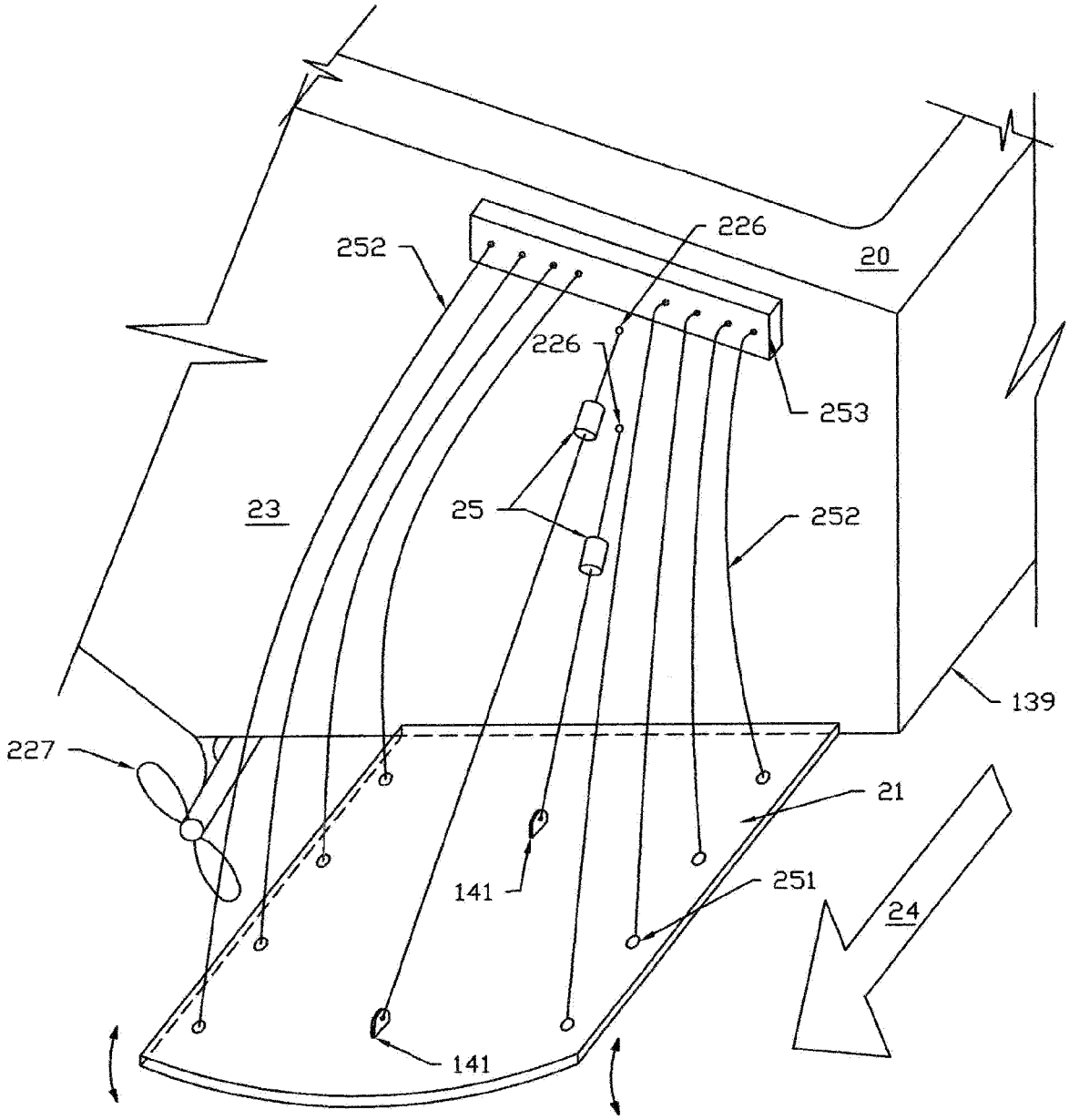
FIG. 41 is a perspective view of a boat and a trim tab shape control system according to another embodiment of the present invention that is similar to that shown in FIG. 28 and including an array of pressure sensing ports connected to a logic box located on the boat (the pressure sensing ports and control box are suitable for any configuration trim tab.

FIG. 41 is a perspective view of a boat 20 and a trim tab shape control system according to another embodiment of the present invention that is similar to that shown in FIG. 28 and including an array of pressure sensing ports 251 connected to a logic box 253 located on the boat (the pressure sensing ports and control box are suitable for any configuration trim tab 21). The series of pressure sensing ports 251 may be drilled holes in communication with the trim tab undersurface 101 of the trim tab 21. These ports are connected by pipes 252 (e.g., wires or the like) to the logic box 253 as part of a monitoring and control system used to control the shape of the trim tab 21 to optimize performance without incurring boundary layer separation. The sensing elements may be compact pressure transducers mounted through and flush with the trim tab undersurface 101 and the pipes 252 would actually be wires. FIG. 41 is similar to the simplified versions of FIG. 26 and FIG. 27.

Figure 42:
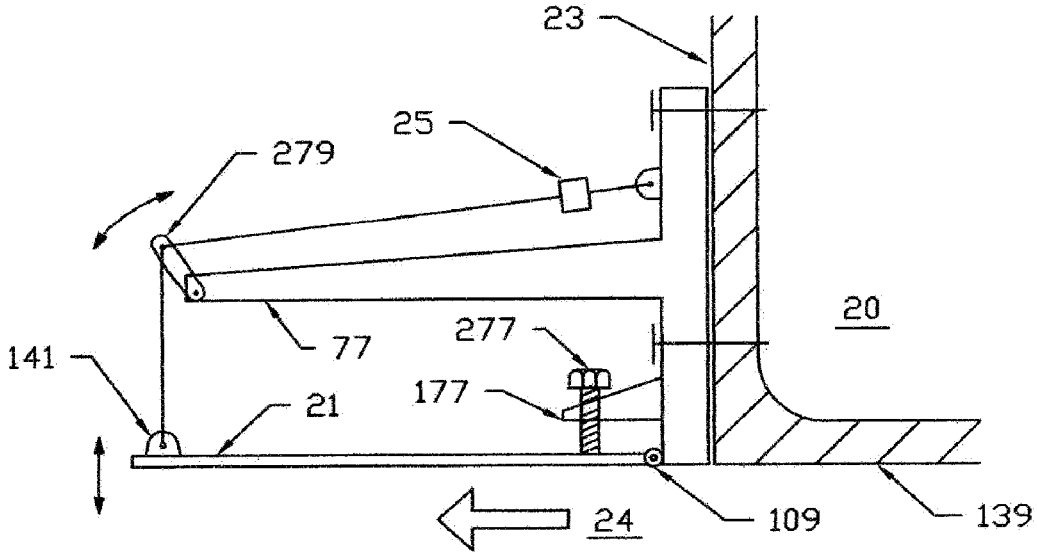
FIG. 42 is a side view of a boat and a trim tab shape control system according to another embodiment of the present invention that is similar to that shown in FIG. 9 but improved by eliminating one force ram and substituting a backstop and an adjustment screw for imposing a bend point of the trim tab near to the transom of the boat.

FIG. 42 is a side view of a boat 20 and a trim tab shape control system according to another embodiment of the present invention that is similar to that show in FIG. 9 but improved by eliminating one force ram 25 and substituting a backstop 77 and an adjustment screw 277 for imposing a bend point of the trim tab 21 near to the transom 23 of the boat 20. This bend point is in effect only when to trim tab 21 is pulled up above the neutral position by force ram 25.

When the trim tab 21 is in the down position, the hinge 109 at the transom 23 allows the trim tab 21 to swing down freely to any position as determined by the amount of extension of force ram 25. Force ram 25 pushes or pulls on crank arm 279 which in turn pushes or pulls on ear 141 attached to trim tab 21 and causes the trim tab 21 to be moved down or up. This simplification in FIG. 42 sacrifices the ability to control the adjustment of the bend point from a remote location as was attainable using the FIG. 9 configuration.

Figure 43:
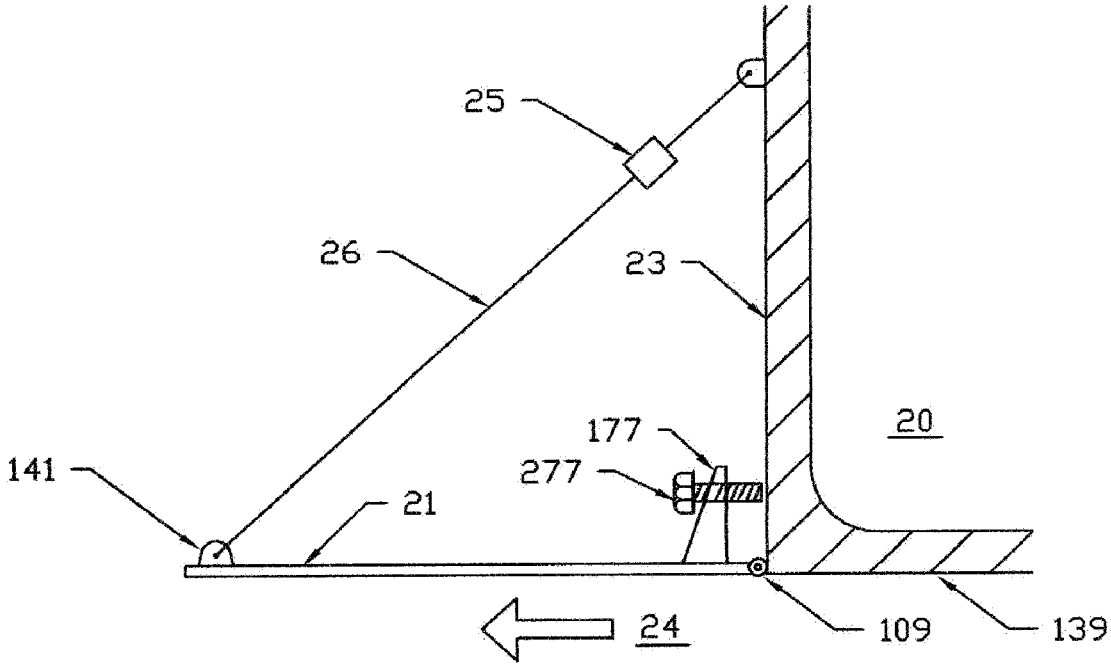
FIG. 43 is a side view of a boat and a trim tab shape control system according to another embodiment of the present invention that is similar to that shown in FIG. 30 including the backstop and the adjustment screw and eliminating the yardarm.

FIG. 43 is a side view of a boat 20 and a trim tab shape control system according to another embodiment of the present invention that is similar to that shown in FIG. 30 including the backstop 177 and the adjustment screw 277 and eliminating the yardarm 77. The trim tab 21 is connected to the transom 23 by a hinge 109 which allows the trim tab 21 to swing up and down as determined by the force ram 25 acting through ear 141 mounted to the rearward end of the trim tab 21. The adjusting screw 277 is adjusted to just start to contact the transom 23 when the trim tab 21 is in the neutral position. When the force ram 25 pulls up on the trim tab 21, the trim tab 21 is now bent to cause a smooth transition in slope as the water 24 flows from the bottom 139 of the boat 20 to the bottom of the trim tab 21. The backstop 177 and adjustment screw 277 are functionally equivalent to the same parts as shown in FIG. 42. When the trim tab 21 is in the down position, the back stop 177 and adjustment screw 277 are not in contact with the transom 23, and the trim tab 21 is free to rotate about hinge 109.

Figure 44:
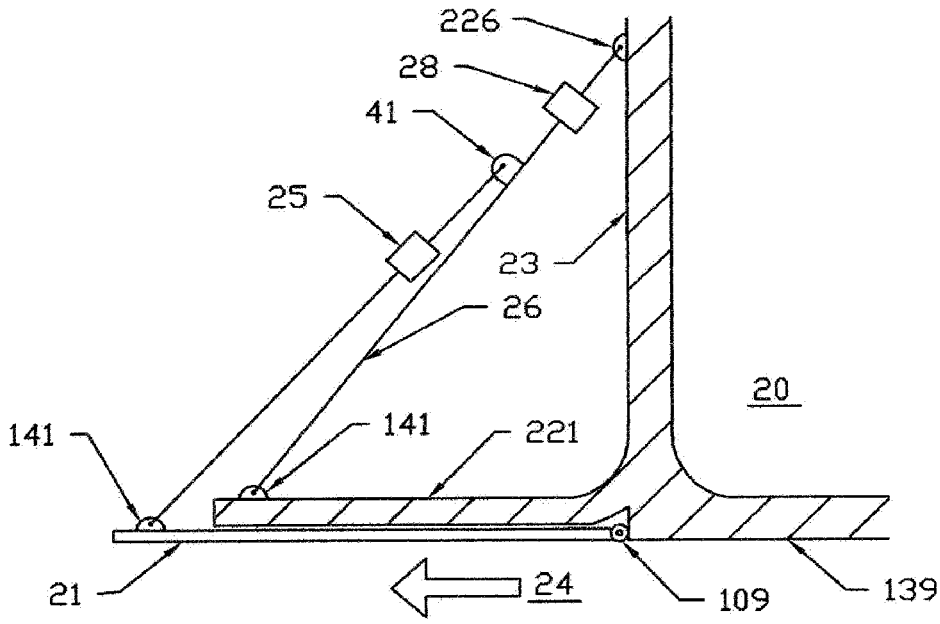
FIG. 44 is a side view of a boat and a trim tab shape control system according to another embodiment of the present invention similar to that shown in FIG. 37 except that the platen is an extension of the transom rather than a tapered member of regressive flexural stiffness.

FIG. 44 is a side view of a boat 20 and a trim tab shape control system according to another embodiment of the present invention similar to that shown in FIG. 37 except that the platen 221 is an extension of the transom 23 rather than a tapered member of regressive flexural stiffness. This simplification may allow less expensive manufacturing methods, however, it may cause a slight decrease in boundary layer control. The transom extension operates as a platen 221 of uniform flexural stiffness affixed rigidly to the transom 23 of the boat 20. The platen 221 is moved up and down by platen ram 28 that is attached to the transom by transom ears 226. The trim tab 21 is a flexible piece of material, for example sheet metal, that is secured to the boat 20 at the transom 23 by means of a hinge 109. The trim tab is moved up and down by means of a force ram 25. Force ram 25 is attached to rod ears 41 at the upper end and ears 141 at the lower end. Rod ear 41 is attached to force rod 26 that is an extension of platen ram 28 and serves as an upper anchor point for force ram 25. Therefore, the trim tab is referenced to changes in position of the force rod, hence the platen, yet can be moved additionally by force ram 25 to serve in the down trim position. This allows the force rams that control the trim tab 21 to be lighter duty and faster acting than the platen rams that control the platen 221.

Figure 45:
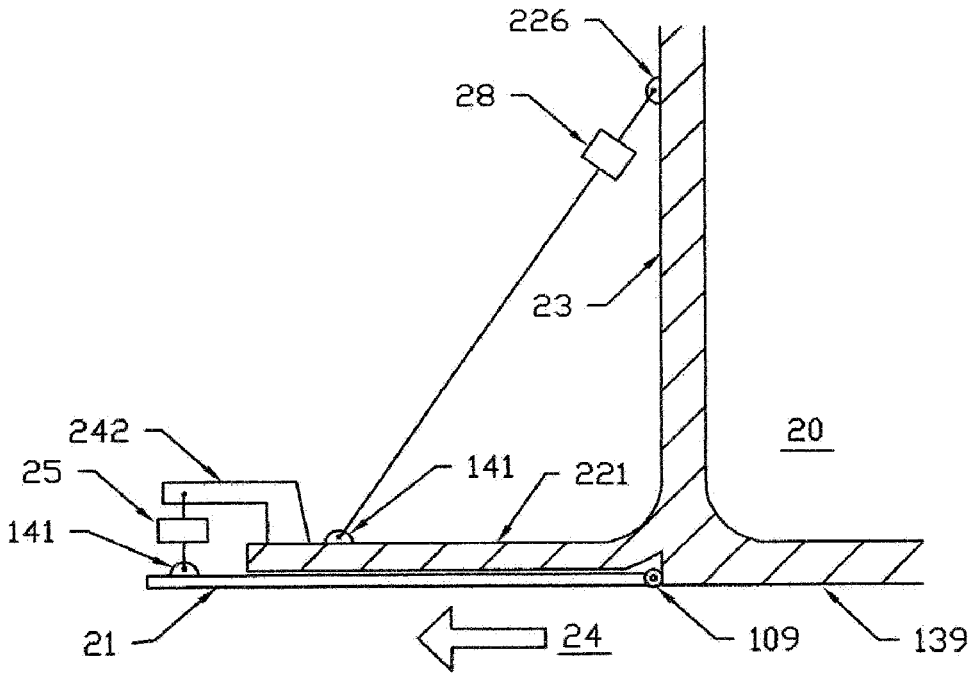
FIG. 45 is a side view of a boat and a trim tab shape control system according to another embodiment of the present invention which is an improvement over that shown in FIG. 44 in which control of the trim tab is accomplished by a force ram connected to a platen by means of platen brackets.

FIG. 45 is a side view of a boat and a trim tab shape control system according to another embodiment of the present invention which is an improvement over that shown in FIG. 44 in which the control of the trim tab 21 is now accomplished by a force ram 25 connected to the platen 221 by means of platen brackets 242. This arrangement is functionally equivalent to that of FIG. 44 except that it reduces some of the clutter above the platen. As the platen is moved up and down by platen ram 28, the platen bracket 242 moves with the rearward end of the platen. The trim tab is moved up and down by the force ram 25 attached to the platen bracket and the ears mounted to the trim tab.

Figure 46:
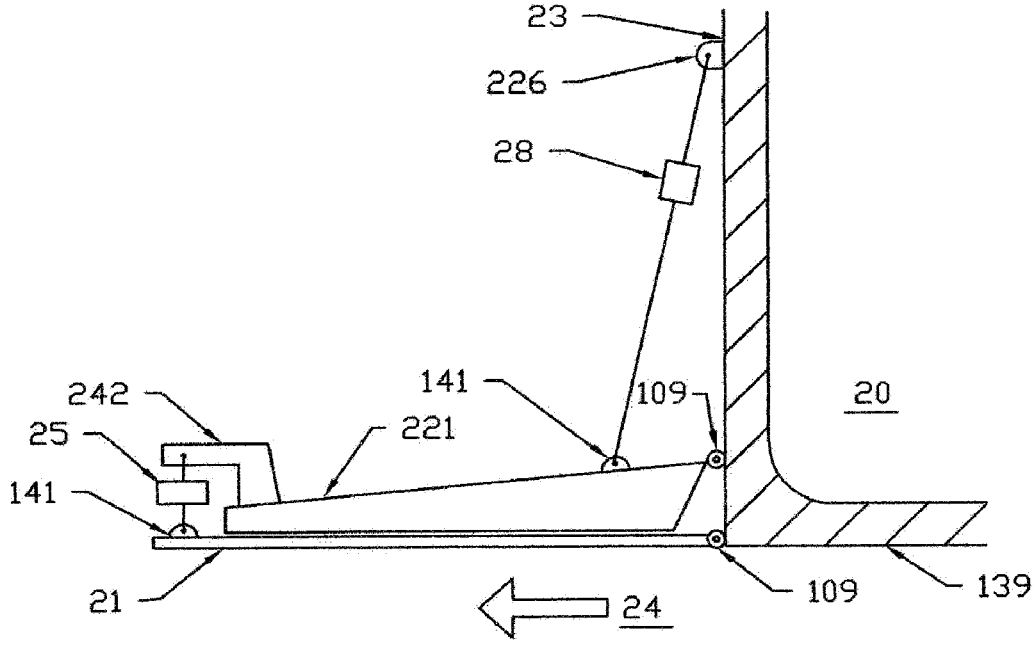
FIG. 46 is a side view of a boat and a trim tab shape control system according to another embodiment of the present invention which is a variation of that shown in FIG. 39 using the platen bracket of FIG. 45 to move the trim tab up and down.

FIG. 46 is a side view of a boat and a trim tab shape control system according to another embodiment of the present invention which is a variation of that shown in FIG. 39 and which uses the platen bracket 242 to move the trim tab 21 up and down. In FIG. 46, the platen ram 28 moves up and down to control the position of the platen 221 which is affixed to the transom 23 by hinge 109. The trim tab 21 is attached by ears 141 to the force ram 25 which in turn is attached to the platen by the platen bracket 242. This arrangement reduces clutter above the platen.

Figure 47:
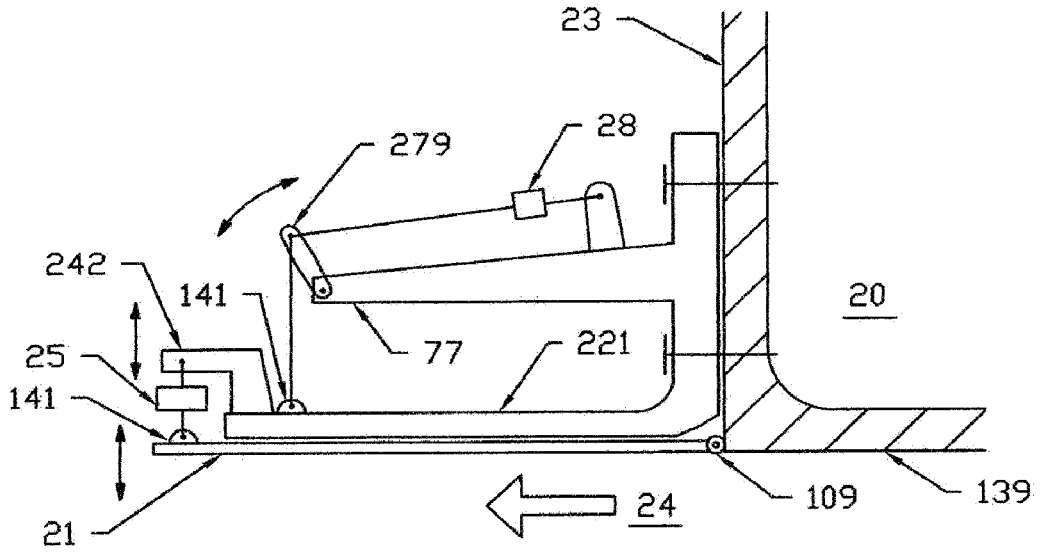
FIG. 47 is a side view of a boat and a trim tab shape control system according to another embodiment of the present invention using a combination of the improvements illustrated in FIGS. 42 and 45.

FIG. 47 is a side view of a boat 20 and a trim tab shape control system according to another embodiment of the present invention using a combination of the improvements illustrated in FIGS. 42 and 45. This combination is most useful if there are severe overhead room restrictions that require the operating mechanism to be designed to be close to the trim tab. A good example of such a design constraint would be the need for a swim platform to be attached to the back of the boat, yet over the top of the trim tab mechanism. FIG. 47 uses the yardarm 77 of FIG. 42 to control the platen 221 and uses the platen bracket 242 of FIG. 45 to control the trim tab 21. This construction results in a vertically compact assembly.

It is now appreciated that a trim tab shape control system according to various embodiments of the present invention recognizes the need for an effective way to trim a boat up and down using trim tabs and uses the concept of a bendable thin plate. In one embodiment, the amount of bend is controlled by using at least one force ram located above a resilient plate trim tab attached to the boat. Additional means are provided for controlling the shape of the operative bottom surface of the trim tab when pulled into an up position. This allows the bending to be curved to the exact shape to optimize the operating conditions of the boat. Fluid dynamics shows that the "up" curvature is the one that needs to be most closely tuned to the operating condition of the boat due to the desire of avoiding boundary layer separation of the water from the undersurface of the trim tab. This boundary layer separation is caused by the formation of an adverse pressure gradient at the undersurface of the trim tab. Conversely, down trim does not cause these adverse pressure gradients and therefore boundary layer separation is not a problem. The more that the trim tab is pulled up, the more the flow tends to separate. Pressure sensors may be employed with communications piped from the bottom of the trim tab to a smart logic box to monitor local boundary layer pressures to determine incipient flow separation and to make necessary adjustments to the trim tab deflection.

A trim tab shape control system according to embodiments of the present invention also recognizes the need for greater down trim deflection to get a boat over hump speed when the bow rises far out of the water as the boat struggles to get up on plane. This exaggerated downward deflection may cause prior art trim tabs to fail by fatigue or ductile failure.

A trim tab shape control system according to embodiments of the present invention further contemplates use of these trim tabs as part of a stabilizing system for boats traversing rough seas causing the boat to both pitch and roll on the waves. This stabilizing system uses an inertial control system to cause the force rams to move the trim tabs in a simultaneous up and down motion to quell the pitching motion of the boat. The stabilizing system also causes the force rams to move the trim tabs in opposing up and down motions to quell the rolling motion of the boat. A trim tab shape control system according to an embodiment of the present invention is suited for this use because it allows exaggerated motions and long cycle life of the one or more trim tabs without failure and allows for precise up trim motions not attainable with prior art hinged trim tabs.

A trim tab shape control system according to embodiments of the present invention allows the trim tab to be constructed of a simple sheet of flexible sheet metal for a cost savings advantage over prior art. This sheet metal can be simply bolted to the boat for a cantilever connection or can be hinged to the boat.

A trim tab shape control system according to the present invention can also be built in a version with fewer force rams by substituting the use of progressive springs, tapered cantilevered springs, jack screws, toggles, and fluid bladders to control the upward curvature and upward motion limit stops of the trim tab.

A trim tab shape control system according to embodiments of the present invention also contemplates use with a surface drive propulsion system wherein the propeller shaft is routed over the top of the trim tab and the blade immersion of the propeller, or propeller bite, is controlled by an actuator connected to the trim tab.

In one embodiment of the present invention the benefits of a flexing trim tab are merged with the benefits of a hinged trim tab. The flexible trim tab allows for a curvature most suited to good hydrodynamic performance. Flexible trim tabs also allow for the trim tab to most smoothly blend with the flow lines of the rushing water as it exits from under the boat and continues under the trim tab. However, the present inventor has also recognized the benefits of being able to move the trim tab to extreme down and extreme up positions for transport or for pushing back off a beach when landed too high or when the tide recedes. Both of these features have benefits for the military.

A trim tab shape control system according to embodiments of the present invention further contemplates the use of special coatings on the trim tabs to resist biological growths like barnacles and moss. Coatings include Teflon®, other polymers, and ceramics. The use of Teflon® also reduces the fluid friction drag of the trim tab. Teflon® is used in the general sense to include all varieties of polytetrafluoroethylene or PTFE.

A trim tab shape control system according to embodiments of the present invention contemplates the use of force rams including hydraulic piston and cylinders, jack screws, camshafts, springs, toggles, bladders, and piezoelectric and electrostrictive materials including shape memory alloys. Piezoelectric and electrostrictive materials exhibit a displacement when energized with electricity, where the displacement may be a contraction or expansion. The commonly used abbreviation for shape memory alloy is SMA. This new technology is often an alloy of nickel and titanium with the useful characteristic of developing large forces while having a high strain deformation of up to 8 percent when energized with electricity.

A trim tab shape control system according to embodiments of the present invention is designed and constructed to allow "up trim" using a control system to deflect the undersurface of the trim tab in a selected curvature to minimize boundary layer separation of the water from the trim tab. In addition, the trim tabs also deflect downward to control "down trim" by either hinged action or by simple bending of a thin flexible sheet of resilient material such as sheet metal.

The amount of downward deflection required in normal boating activities is often far greater than the amount required for the upward deflection. This is because the exaggerated downward deflection of the trim tab is necessary for the trim tab to act like a ski to raise the back of the boat while the boat is struggling to get over hump speed, or the speed at which a boat transitions from a displacement mode to a planing mode. This struggle is often seen as the boat squatting down in the rear with the bow way high in the air. The use of a hinged trim tab allows for the trim tab to move to an exaggerated downward position without imposing undue bending or fatigue stresses on the trim tab. The downward deflection curvature is not such a critical control parameter as is the upward deflection curvature because it is impossible to have the boundary layer of water separate from the trim tab when in the down position.

A trim tab shape control system according to embodiments of the present invention is also useful as part of a dynamic stabilizing system for a boat that is experiencing large pitching and rolling motions due to large waves. This dynamic stabilizing system uses a smart logic box which controls the up and down motions of the trim tabs to quell the wave induced motions of the boat. An array of pressure sensing ports monitor boundary layer pressures under the trim tabs.

A trim tab shape control system according to embodiments of the present invention optionally uses a slippery coating on the undersurface of the trim tab to decrease friction drag and to deter biological fouling. In one embodiment, Teflon® is used as a coating and is readily available as Teflon® coated stainless sheet metal.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for carrying out the same purposes of the present invention without departing from the spirit and scope of the invention as defined by the appended claims.

What is claimed is:

1. A trim tab shape control system for a boat with a transom, comprising:

a flexible plate having a forward end for attaching to the transom of the boat, a rearward end, and an operative bottom surface; and a trim tab control system, for attaching to the transom of the boat, comprising a first force mechanism that is attached near said rearward end of said flexible plate and at least one second force mechanism interfacing said flexible plate between the transom and said first force mechanism, wherein said first and second force mechanisms are operative to deflect said operative bottom surface of said flexible plate in a controlled curve from said forward end to said rearward end in an up position and to retain a shape in a down position which varies with force applied by at least one of said first and second force mechanisms and operating conditions of the boat.

2. The trim tab shape control system of claim 1, wherein said controlled curve has a parabolic shape.

3. The trim tab shape control system of claim 1, wherein said flexible plate is attached with hinges to the transom of the boat.

4. The trim tab shape control system of claim 1, wherein said flexible plate is attached to the transom of the boat as a cantilever.

5. The trim tab shape control system of claim 1, wherein said flexible plate has a uniform thickness from said forward end to said rearward end.

6. The trim tab shape control system of claim 1, wherein:

said second force mechanism comprises a resilient platen having a forward end for attaching to the transom of the boat immediately above said flexible plate and having a rearward end, wherein said resilient platen has a regressive flexural stiffness from said forward end to said rearward end of said resilient platen; and wherein said first force mechanism pulls said flexible plate against said resilient platen to form said operative bottom surface into said controlled curve when said first upward force is applied.

7. The trim tab shape control system of claim 1, wherein:

said second force mechanism comprises:

a resilient platen having a forward end for attaching to the transom of the boat immediately above said flexible plate and having a rearward end, wherein said platen has a uniform thickness; and a plurality of platen rams coupled along said resilient platen between said forward end and said rearward end of said resilient platen and each for attaching to the transom of the boat;

wherein said first force mechanism comprises a force ram coupled to said rearward end of said flexible plate and for attaching to the transom of the boat for applying said upward and downward forces; and wherein said force ram pulls said flexible plate against said resilient platen and wherein said plurality of platen rams are displaced to form said operative bottom surface of said flexible plate into said controlled curve.

8. The trim tab shape control system of claim 1, wherein said first and second force mechanisms comprise:

a yardarm for attaching to the transom of the boat above said flexible plate; and a plurality of force rams interfaced with said flexible plate between said forward end and said rearward end of said flexible plate and each attached to said yardarm.

9. The trim tab shape control system of claim 8, wherein at least one of said plurality of force rams comprises a shoe for interfacing said flexible plate.

10. The trim tab shape control system of claim 1, wherein:

said second force mechanism comprises a platen comprising a stack of progressively shorter lengths of cantilevered beams of uniform thickness attached to the transom of the boat immediately above said flexible plate; and wherein said first force mechanism pulls said flexible plate against said resilient platen to form said operative bottom surface into said controlled curve.

11. The trim tab shape control system of claim 10, wherein each cantilevered beam includes a pad to separate said stack of cantilevered beams from each other and from said flexible plate.

12. The trim tab shape control system of claim 1, wherein said trim tab control system comprises:

a yardarm for attaching to the transom of the boat above said flexible plate;

wherein said first control mechanism comprises a force ram coupled to said rearward end of said flexible plate and attached to said yardarm for applying said upward and downward forces; and wherein said second force mechanism comprises a plurality of springs attached to said yardarm and interfaced with said flexible plate between said forward end and said rearward end.

13. The trim tab shape control system of claim 1, wherein said trim tab control system comprises:

a yardarm for attaching to the transom of the boat above said flexible plate;

wherein said first control mechanism comprises a force ram attached to said rearward end of said flexible plate and attached to said yardarm for applying said upward and downward forces; and wherein said second force mechanism comprises a plurality of mechanical devices interfaced said forward end and said rearward end of said flexible plate and each attached to said yardarm.

14. The trim tab shape control system of claim 13, wherein said plurality of mechanical devices comprises a plurality of jackscrews.

15. The trim tab shape control system of claim 13, wherein said plurality of mechanical devices comprises a plurality of cams.

16. The trim tab shape control system of claim 13, further comprising:

a ramp attached to an underside of said yardarm; and wherein said plurality of mechanical devices comprises a plurality of rods that slide along said ramp.

17. The trim tab shape control system of claim 1, wherein said trim tab control system comprises:

a yardarm for attaching to the transom of the boat above said flexible plate;

wherein said first control mechanism comprises a force ram coupled to said rearward end of said flexible plate and attached to said yardarm for applying said upward and downward forces; and wherein said second force mechanism comprises:

a plurality of extendable toggles attached to said yardarm; and a plurality of rollers, each attached to a corresponding one of said extendable toggles, that interface said flexible plate between said forward end and said rearward end of said flexible plate.

18. The trim tab shape control system of claim 1, wherein said trim tab control system comprises:

a yardarm for attaching to the transom of the boat above said flexible plate;

wherein said first control mechanism comprises a force ram coupled to said rearward end of said flexible plate and attached to said yardarm for applying said upward and downward forces; and wherein said second force mechanism comprises a plurality of bladders interfaced between said yardarm and said flexible plate and distributed between said forward end and said rearward end of said flexible plate.

19. The trim tab shape control system of claim 1, wherein said trim tab control system comprises:

a plurality of pressure sensing ports in communication with said operative bottom surface of said flexible plate;

said first and second force mechanisms comprising a plurality of actuators interfacing said flexible plate between said forward end and said rearward end of said flexible plate; and a logic box communicatively interfaced with said plurality of pressure sensing ports and said plurality of actuators to optimize performance of the boat.

20. The trim tab shape control system of claim 19, wherein said plurality of pressure sensing ports are arranged in a two dimensional array.

21. The adjustable trim table of claim 19, wherein said logic box controls said plurality of actuators based on communications from said plurality of pressure sensing ports to decrease pitch action of the boat.

22. The trim tab shape control system of claim 19, wherein said logic box controls said plurality of actuators based on communications from said plurality of pressure sensing ports to decrease roll action of the boat.

23. The trim tab shape control system of claim 1, wherein said trim tab control system comprises a backstop and adjustment screw interfaced between the transom of the boat and said flexible plate.

24. The trim tab shape control system of claim 1, wherein:

said second force mechanism comprises:

a resilient platen integrally mounted to the transom of the boat immediately above said flexible plate and having a rearward end; and a platen ram for attaching to the transom of the boat and mounted to said resilient platen; and wherein said first force mechanism pulls said flexible plate against said resilient platen to form said operative bottom surface into said controlled curve.

25. The trim tab shape control system of claim 24, wherein said first force mechanism comprises a force ram attached between said platen ram and said flexible plate.

26. The trim tab shape control system of claim 24, wherein said first force mechanism comprises a force ram attached between said resilient platen and said flexible plate.

27. The trim tab shape control system of claim 1, wherein:

said flexible plate is pivotally attached to the transom of the boat;

wherein said second force mechanism comprises:

a platen pivotally attached to the transom of the boat immediately above said flexible plate and having a rearward end;

a platen ram for attaching to the transom of the boat and attached to said platen; and wherein said first force mechanism pulls said flexible plate against said platen to form said operative bottom surface into said controlled curve.

28. A boat, comprising:

a hull with a transom; and a trim tab shape control system attached to said transom, comprising:

a flexible plate having a forward end attached to said transom, a rearward end, and an operative bottom surface; and a trim tab control system, attached to said transom, comprising a first force mechanism that is attached near said rearward end of said flexible plate and at least one second force mechanism interfacing said flexible plate between the transom and said first force mechanism, wherein said first and second force mechanisms are operative to deflect said operative bottom surface of said flexible plate in a controlled curve from said forward end to said rearward end in an up position and to retain a shape in a down position which varies with force applied by at least one of said first and second force mechanisms and operating conditions of the boat.

29. A boat, comprising:

a hull with a transom; and a trim tab shape control system attached to said transom, comprising:

a flexible plate having a forward end attached to said transom, a rearward end, an operative bottom surface, and a plurality of pressure sensing ports in communication with said operative bottom surface; and a trim tab control system, attached to said transom, comprising a first force mechanism that is attached near said rearward end of said flexible plate and at least one second force mechanism interfacing said flexible plate between the transom and said first force mechanism, wherein said first and second force mechanisms are operative to deflect said operative bottom surface of said flexible plate in a controlled curve from said forward end to said rearward end in an up position and to retain a shape in a down position which varies with force applied by at least one of said first and second force mechanisms and operating conditions of the boat; and a logic box communicatively interfaced with said plurality of pressure sensing ports and said trim tab control system.

* * * * *